US007456680B2

(12) United States Patent
Gyohten et al.

(10) Patent No.: US 7,456,680 B2
(45) Date of Patent: Nov. 25, 2008

(54) INTERNAL VOLTAGE GENERATING CIRCUIT AND SEMICONDUCTOR INTEGRATED CIRCUIT DEVICE

(75) Inventors: Takayuki Gyohten, Hyogo (JP); Fukashi Morishita, Hyogo (JP)

(73) Assignee: Renesas Technology Corp., Chiyoda-Ku, Tokyo (JP)

( * ) Notice: Subject to any disclaimer, the term of this patent is extended or adjusted under 35 U.S.C. 154(b) by 33 days.

(21) Appl. No.: 11/135,488

(22) Filed: May 24, 2005

(65) Prior Publication Data

US 2005/0264347 A1 Dec. 1, 2005

(30) Foreign Application Priority Data

May 25, 2004 (JP) ..... 2004-154416

(51) Int. Cl.
*G05F 1/10* (2006.01)
*G05F 3/02* (2006.01)

(52) U.S. Cl. ..... 327/541

(58) Field of Classification Search ..... 327/538, 327/540, 541, 543; 323/316
See application file for complete search history.

(56) References Cited

U.S. PATENT DOCUMENTS 4,161,678 A * 7/1979 Kaieda et al. ..... 318/641
4,439,739 A * 3/1984 Kilian et al. ..... 330/107
5,175,451 A * 12/1992 Ihara ..... 327/54
5,699,012 A * 12/1997 Hakkarainen ..... 330/9
5,811,993 A * 9/1998 Dennard et al. ..... 327/54
6,011,428 A * 1/2000 Tsukude et al. ..... 327/541
6,058,061 A * 5/2000 Ooishi ..... 365/222
6,097,180 A * 8/2000 Tsukude et al. ..... 323/313
6,774,712 B2 * 8/2004 Rhee et al. ..... 327/540
6,774,713 B2 * 8/2004 Watanabe ..... 327/540
6,784,934 B1 * 8/2004 Watanabe ..... 348/308
6,937,088 B2 * 8/2005 Hamamoto et al. ..... 327/541
2002/0030537 A1 * 3/2002 Kobayashi et al. ..... 327/541
2003/0107430 A1 * 6/2003 Casper ..... 327/540

FOREIGN PATENT DOCUMENTS

JP 10-239357 9/1998
JP 2000-353785 12/2000
JP 2003-168290 6/2003

* cited by examiner

*Primary Examiner*—Quan Tra
(74) *Attorney, Agent, or Firm*—Buchanan Ingersoll & Rooney PC

(57) ABSTRACT

A voltage for reference at a voltage level higher than a target value is produced from a constant current provided from a constant current generating circuit, and is subjected to resistance division by a resistance division circuit to produce a reference voltage at the target level, and then a final reference voltage is produced by a voltage follower. An internal voltage generating circuit thus provided can generate the reference voltage having the desired voltage level with high accuracy as well as an internal voltage based on the reference voltage by controlling temperature characteristic even with a low power supply voltage.

3 Claims, 14 Drawing Sheets

INTERNAL VOLTAGE GENERATING CIRCUIT AND SEMICONDUCTOR INTEGRATED CIRCUIT DEVICE

BACKGROUND OF THE INVENTION

1. Field of the Invention

The present invention relates to an internal voltage generating circuit and a semiconductor integrated circuit device using the same, and particularly to an internal voltage generating circuit, which can precisely produce an internal voltage stably having a desired temperature characteristic even with a low power supply voltage, and a semiconductor integrated circuit device, in which the internal voltage generating circuit can be arranged with high area utilizing efficiency for stable transmission of to various elements on a chip.

2. Description of the Background Art

Owing to development of a semiconductor miniaturization technology in recent years, elements have been miniaturized to a higher extent, and high-density integration can now be achieved. The high-density integration has actualized an integrated circuit device, which includes a plurality of function circuits formed on a single chip to form one system, and is referred to as a System On Chip (SOC) or a system LSI (Large Scale Integrated circuit). Among various uses, mobile communication terminal devices, movie processing and communication networks strongly require such system LSIs, and these uses require high operation frequencies and low power consumption. In these uses, it is necessary to employ a power supply, which allows increase in current consumption due to a fast operation, to lower a leak current (off-leak current) flowing through a MOS transistor (insulated gate field-effect transistor) in an off state, and to lower current consumption, e.g., by lowering a power supply voltage.

For example, when an eDRAM (embedded Dynamic Random Access Memory), which is a kind of mixed-type memory arranged together with a logic such as a processor on a single chip, is used for conventional image processing, image data is transferred in a sequential fashion. Therefore, it is required only to increase operation speeds of column-related circuits, which are provided in connection with selection of the memory cell column, and current consumption is relatively small even in a fast operation. In the movie image processing, communication network or the like, data are often accessed in a random fashion, and for the fast operation in this random access, row-related circuits selecting the memory cell rows must operate fast so that the current consumption increases in the fast operation. For the above uses, it is required, in addition to stable supply of an operation current, to suppress the current consumption to the extent possible, e.g., by lowering the off-leak current and employing the low power supply voltage. For satisfying the above requirements, it is necessary to provide an internal voltage generating circuit, which can operate with a high operation frequency, and can stably supply an internal voltage and an internal power supply voltage with high precision even with a low power supply voltage.

For example, in a conventional system-on-chip having a memory and a logic arranged on the same semiconductor chip in a mixed fashion, a power supply circuit is arranged for each of a memory core circuit and a logic core circuit. In the memory core circuit, it is necessary, e.g., for a DRAM, to employ a constant voltage generating circuit, which precisely generates a constant voltage to be used for producing a sense amplifier power supply voltage for detecting a memory cell data, a circuit generating a negative voltage to be applied as a bias voltage to a back gate of a memory cell transistor, a circuit generating a boosted voltage to be transmitted to a word line, and a circuit generating a divided voltage for precharging bit lines during a standby state. In the logic core circuit, it may be necessary for suppressing off-leak current components of transistors to employ a circuit supplying a back gate bias voltage of the transistor as well as a circuit maintaining a negative voltage on a gate of the transistor in the off state. For generating these voltages, it is necessary to employ a circuit generating a reference voltage used as a reference for all voltages as well as a circuit generating a constant current.

However, if the power supply voltage is lowered for reducing the power consumption, these reference voltage generating circuit and constant current generating circuit operate in circuit operation regions close to threshold voltages of transistors, and it becomes difficult to operate stably the MOS transistors and to adjust circuit operation characteristics. In particular, for adjusting the temperature characteristics, a plurality of elements for compensating temperature characteristics are connected in series within a circuit, and a relatively large voltage difference is required for selectively setting these elements to active;/inactive states. Therefore, it becomes difficult to adjust sufficiently the temperature characteristics with a low power supply voltage.

A structure for accurately setting a negative voltage is disclosed in Japanese Patent Laying-Open No. 10-239357. In Japanese Patent Laying-Open No. 10-239357, a reference voltage having small temperature dependence is produced, and a MOS transistor is resistance-connected in series between an MOS transistor receiving on its gate the reference voltage and a negative voltage. Also, a reference transistor having a gate receiving the reference voltage and a source connected to a ground node is employed, and a current mirror supplies a current to the reference transistor as well as the above resistance-connected MOS transistor. By utilizing the fact that same gate-source voltage difference occurs in the resistance-connected MOS transistor and the series MOS transistor receiving the reference voltage on the gate, it is intended to detect a level of a negative voltage, which is an integral multiple of reference voltage Vref.

Japanese Patent Laying-Open No. 2003-168290 has disclosed an internal voltage down converter circuit, which stably produces an internal voltage even with a low power supply voltage. In a structure disclosed in this Japanese Patent Laying-Open No. 2003-168290, two differential stages formed of NMOS transistors are arranged in parallel, and two comparators thereof compare an internal power supply voltage with reference voltages at different voltage levels, respectively. According to the output signals of these comparator circuits, electric charges are supplied to or pulled out from an internal voltage line. By employing the differential stages formed of the NMOS transistors, it is intended to perform stably a differential amplifying operation even with a low power supply voltage.

A Japanese Patent Laying-Open No. 2000-353785 has disclosed a structure, which is intended to transmit stably an internal voltage to each of circuits in a memory chip over long distances. In the structure disclosed in Japanese Patent Laying-Open No. 2000-353785, the internal voltage transmission lines are surrounded by shield interconnections, which are fixed to a ground voltage and are arranged on the laterally opposite sides thereof and in upper and lower layers thereof.

In the structure disclosed in Japanese Patent Laying-Open No. 10-239357, the level of the negative voltage is detected by utilizing a reference voltage having small temperature dependence. However, no consideration is given to a manner of adjusting temperature characteristics of this reference voltage as well as a manner of stably producing the reference voltage with a low power supply voltage.

In the structure disclosed in Japanese Patent Laying-Open No. 2003-168290, comparing circuits of a current mirror type operate to adjust the level of the internal stepped-down voltage even with a low power supply voltage. Although the above operation is based on the premise that the reference voltage applied to the comparing circuit is produced based on a reference voltage independent of a temperature, no consideration is given to a manner of producing the reference voltage not having the temperature dependence.

Although Japanese Patent Laying-Open No. 2000-353785 has disclosed a structure, in which shield interconnections surround the internal voltage transmission lines in one memory chip, no consideration is given to an arrangement of a power supply circuit in a system LSI or the like having a plurality of core circuits therein.

SUMMARY OF THE INVENTION

Accordingly, an object of the invention is to provide an internal voltage generating circuit, which can easily adjust temperature characteristics, and thereby can generate a precise reference voltage.

Another object of the invention is to provide an internal voltage generating circuit, which can produce an internal voltage with low current consumption even in a fast operation by utilizing the above reference voltage.

Still another object of the invention is to provide a semiconductor integrated circuit device provided with a power supply circuit, which can produce an internal voltage with low current consumption even in a system LSI.

Yet another object of the invention is to provide a semiconductor integrated circuit device, which can stably supply an internal voltage to a plurality of core circuits with low power consumption even under conditions of low power supply voltage.

An internal voltage generating circuit according to a first aspect of the invention includes a first reference voltage generating circuit generating a first reference voltage, and a voltage dividing circuit producing a second reference voltage according to the first reference voltage. The voltage dividing circuit includes a voltage-follower-connected differential amplifier receiving the first reference voltage, and a divided voltage output circuit dividing an output voltage of the differential amplifier to produce and output the second reference voltage.

A semiconductor integrated circuit device according to a second aspect of the invention includes a plurality of core circuits arranged on a single chip and each achieving a predetermined function, a standby module arranged commonly to the plurality of core circuits, and including a voltage generating circuit consuming a first consumption current during standby, and a plurality of active modules arranged corresponding to the plurality of core circuits, respectively, and each having a voltage generating circuit producing an internal voltage according to a voltage provided from the standby module, supplying the internal voltage to the corresponding core circuit, and consuming a second consumption current larger than the first consumption current during an active state.

In the internal voltage generating circuit according to the first aspect of the invention, the voltage-follower-connected differential amplifier circuit receives the first reference voltage, and the second reference voltage is produced by dividing the output voltage of the differential amplifier circuit. The second reference voltage is set as a target voltage level. Therefore, the first reference voltage can be set to a voltage level higher than a desired voltage level, and temperature characteristics of the first reference voltage can be controlled even with a low power supply voltage so that it is possible to produce the reference voltage at the desired voltage level, of which temperature characteristics are adjusted precisely. Also, the internal voltage at a predetermined voltage level can be precisely produced based on the reference voltage thus produced.

In a semiconductor integrated circuit device according to the second aspect of the invention, the standby module is arranged commonly to the plurality of core circuits, and the time required for conducting tests on the current consumption and standby current in the standby mode can be reduced as compared with a structure arranging an independent standby module for each core circuit. It is not necessary to arrange the independent standby module for each core circuit so that an area occupied by the core circuits can be small.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
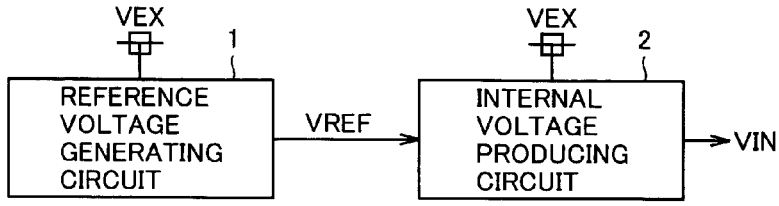
FIG. 1 schematically shows a structure of an internal voltage generating circuit according to the invention.

FIG. 1 schematically shows a structure of an internal voltage generating circuit according to the invention. In FIG. 1, the internal voltage generating circuit includes a reference voltage generating circuit 1 producing a reference voltage VREF, of which temperature characteristic is compensated, from an external power supply voltage VEX, and an internal voltage producing circuit 2, which produces an internal voltage VIN at a desired voltage level from external power supply voltage VEX by utilizing reference voltage VREF.

Reference voltage generating circuit 1 produces reference voltage VREF by performing resistance division on a first reference voltage higher than a target voltage level. The temperature compensation is effected on the first reference voltage, and thereby temperature characteristics of reference voltage VREF are adjusted.

A type of internal voltage VIN produced by internal voltage producing circuit 2 depends on a structure of a semiconductor device utilizing internal voltage producing circuit 2. Internal voltage VIN includes a negative voltage VBB, an internal power supply voltage Vccs, an intermediate voltage Vccs/2 equal to half internal power supply voltage Vccs and a boosted voltage VPP higher than internal power supply voltage Vccs. By utilizing the reference voltage subjected to the temperature compensation, internal voltage producing circuit 2 produces stable internal voltage VIN having a precisely adjusted voltage level and compensated temperature characteristics. Internal voltage VIN may have temperature characteristics, which maintain a constant voltage level over a wide temperature range, or may have negative temperature characteristics, which lowers the voltage level with rising of the temperature. The temperature characteristics are appropriately determined according to a use of internal voltage VIN.

Figure 2:
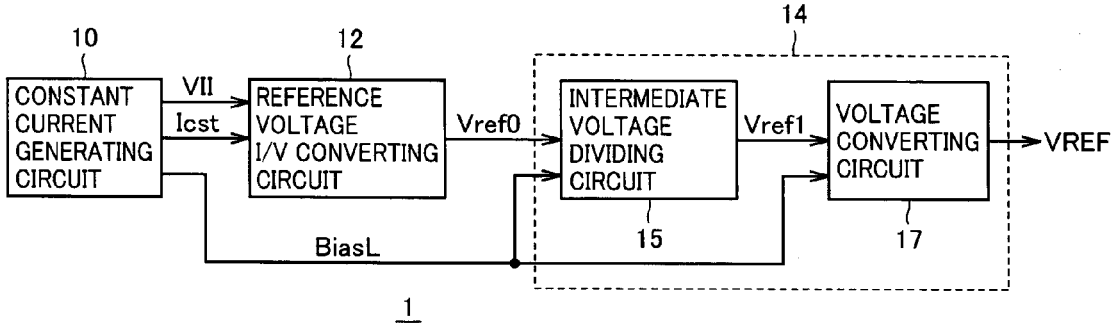
FIG. 2 schematically shows a structure of a reference voltage generating circuit shown in FIG. 1.

FIG. 2 schematically shows a structure of reference voltage generating circuit 1 shown in FIG. 1. In FIG. 2, reference voltage generating circuit 1 includes a constant current generating circuit 10 producing a constant current Icst, a reference voltage I/V converting circuit 12, which converts constant current Icst to a voltage to produce a first reference voltage Vref0, and a dividing circuit 14, which divides first reference voltage Vref0 to produce a second reference voltage Vref Constant current generating circuit 10 internally produces a constant voltage VII and a bias voltage BiasL. These voltages VII and BiasL are produced based on constant current Icst when constant current Icst is produced.

Reference voltage I/V converting circuit 12 compensates the temperature characteristic of constant current Icst produced by constant current generating circuit 10, and thereby produces first reference voltage Vref0 at a voltage level higher than the target voltage level.

Dividing circuit 14 includes an intermediate voltage dividing circuit 15 of a resistance division type performing the resistance division on first reference voltage Vref0) to produce a resistance-divided voltage Vref1, and a voltage converting circuit 17, which finely adjusts the voltage level of the target value of resistance-divided voltage Vref1, and transmits a reference voltage Vref with a large current drive power.

Intermediate voltage dividing circuit 15 of the resistance division type is formed of a series resistance, and performs the resistance division on reference voltage Vref0 to produce a divided voltage Vref1. Accordingly, intermediate voltage dividing circuit 15 of the resistance division type does not adjust the temperature characteristics (because the resistance division does not change the temperature characteristics), and merely converts the voltage level of first reference voltage Vref0. Reference voltage IV converting circuit 12 and/or voltage converting circuit 17 adjust the temperature characteristics of reference voltages Vref0 and/or VREF thus produced.

Figure 3:
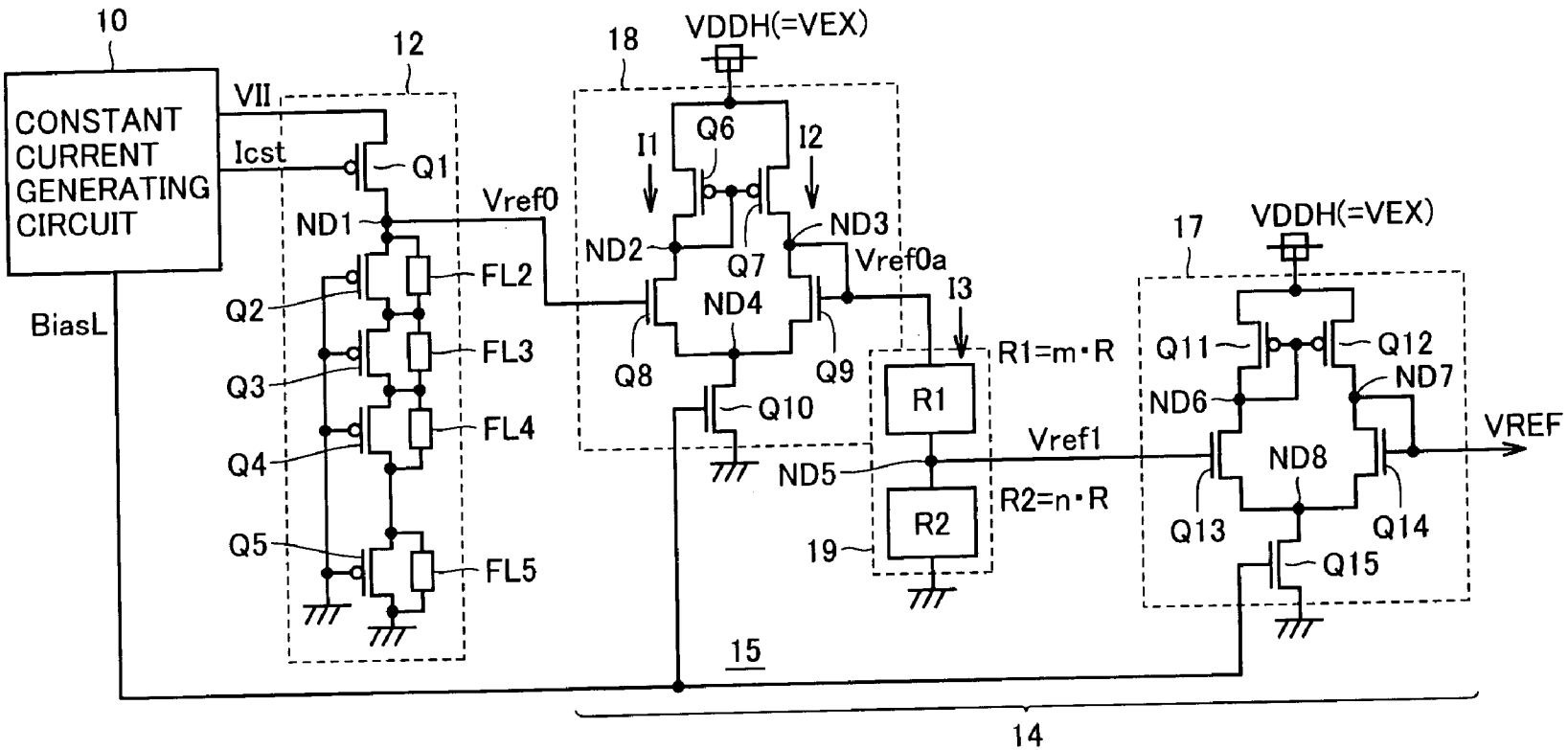
FIG. 3 specifically shows a structure of the reference voltage generating circuit shown in FIG. 2.

FIG. 3 shows a specific structure of a reference voltage generating circuit 1 shown in FIG. 2. In FIG. 3, reference voltage I/V converting circuit 12 includes a P-channel MOS transistor Q1, which receives internal voltage VII from constant current generating circuit 10 as a power supply voltage, and supplies a constant current to a node ND1 according to constant current Icst, as well as P-channel MOS transistors Q2-Q5, which are connected in series between node ND1 and the ground node, and each have a gate connected to the ground node. Programmable short circuit elements FL2-FL5 such as link elements, which can be blown, are provided for MOS transistors Q2-Q5, respectively, so that MOS transistors Q2-Q5 are selectively short-circuited to adjust a composite resistance value, and thereby the voltage level of first reference voltage Vref0 produced on node ND1 is set.

In each of MOS transistors Q2-Q5, a channel resistance has such a positive temperature characteristic that the channel resistance rises with temperature. Conversely, constant current Icst provided from constant current generating circuit 10 has such a negative temperature characteristic that the current value decreases with rising of the temperature. By utilizing MOS transistors Q2-Q5, the temperature characteristic of reference voltage Vref0 is adjusted.

Intermediate voltage dividing circuit 15 of the resistance division type includes a preprocessing circuit, which is a voltage follower circuit 18 of a current mirror type receiving first reference voltage Vref0, for minimizing a current drive power of reference voltage Vref0 and reducing the current consumption of reference voltage INV converting circuit 12. The resistance division processing is performed by a resistance dividing unit 19, which divides an output voltage Vref0*a* of voltage follower circuit 18 of the current mirror type by the resistance.

Voltage follower circuit 18 of the current mirror type includes a P-channel MOS transistor Q6, which is connected between an external power supply node and a node ND2, and has a gate connected to node ND2, a P-channel MOS transistor Q7, which is connected between the external power supply node and a node ND3, and has a gate connected to node ND2, an N-channel MOS transistor Q8, which is connected between nodes ND2 and ND4, and has a gate receiving first reference voltage Vref0, an N-channel MOS transistor Q9, which is connected between nodes ND3 and ND4, and has a gate connected-to node ND3, and an N-channel MOS transistor Q10, which is connected between node ND4 and the ground node, and has a gate receiving bias voltage BiasL.

MOS transistors Q6 and Q7 form a current mirror stage, and MOS transistors Q8 and Q9 form a differential stage. MOS transistor Q9 has a gate and a drain both connected to node ND3, and produces intermediate reference voltage Vref0*a* by converting a current supplied from MOS transistor Q7 to a voltage.

Voltage follower circuit 18 of the current mirror type is formed of a voltage-follower-connected differential amplifier, which has an output and a negative input connected together, and produces intermediate reference voltage Vref0*a* satisfying a relationship expressed by the following formula, where A represents a gain of voltage follower circuit (differential amplifier) 18 of the current mirror type.

$$V\text{ref}0a = A \cdot V\text{ref}0$$

Resistance dividing unit 19 has resistance elements R1 and R2, which are connected in series between node ND3 and the ground node, and produces a reference voltage Vref1 on a connection node ND5 between resistance elements R1 and R2. Resistance elements R1 and R2 are made of resistance materials, e.g., of channel resistances, polycrystalline silicon resistances or diffusion resistances of MOS transistors. Assuming that R represents a unit resistance, resistance element R1 has a resistance value of m·R, and resistance element R2 has a resistance value of n·R. Therefore, the following relationship is present between reference voltage Vref1 and intermediate reference voltage Vref0*a*.

$$\begin{aligned} Vref1 &= n \cdot Vref0a / (m+n) \\ &= n \cdot A \cdot Vref0 / (m+n) \end{aligned}$$

In resistance dividing unit 19, the temperature dependence of the resistance value of resistance element R1 cancels that of resistance element R2 so that reference voltage Vref1 has the same temperature characteristic as first reference voltage Vref0.

Voltage converting circuit 17 is formed of a voltage follower circuit of the current mirror type, i.e., a voltage-follower-connected differential amplifier. More specifically, voltage converting circuit 17 has a P-channel MOS transistor Q11, which is connected between the external power supply node and a node ND7, and has a gate connected to a node ND6, a P-channel MOS transistor Q12, which is connected between the external power supply node and node ND7, and has a gate connected to node ND6, an N-channel MOS transistor Q13, which is connected between nodes ND6 and ND8, and has a gate receiving reference voltage Vref1, an N-channel MOS transistor Q14, which is connected between nodes ND7 and ND8, has a gate connected to node ND7 and produces reference voltage VREF, and an N-channel MOS transistor Q1 5, which is connected between node ND8 and the ground node, and produces bias voltage BiasL on its gate.

MOS transistors Q11 and Q12 form a current mirror stage, and MOS transistors Q13 and Q14 form a differential stage. MOS transistor Q14 functions as a current/voltage converting element, and produces reference voltage VREF by converting the current supplied from MOS transistor Q12 to the voltage.

Voltage converting circuit 17 is provided for producing final reference voltage VREF by adjusting the level and/or temperature characteristic of reference voltage Vref1, and for increasing a current drive supply capacity of reference voltage VREF.

Since constant current generating circuit 10 produces constant current Icst of several microamperes, the current consumption of reference voltage I/V converting circuit 12 is extremely small.

In intermediate voltage dividing circuit 15 of the resistance division type, a current of several microamperes flows through resistance dividing unit 19, and current-mirror-type voltage follower circuit 18 can stably operate with a current of a value merely several times larger than that of the current flowing through resistance dividing unit 19, and thereby can control the output voltage level. For example, it is assumed, as shown in FIG. 3, that a current I1 flows through MOS transistors Q6 and Q8, a current 12 flows through MOS transistor Q7, and a current I3 flows through resistance dividing unit 19. Also, it is assumed that intermediate reference voltage Vref0*a* is lower by 0.1 V than first reference voltage Vref0, and each of MOS transistors Q8 and Q9 has an S-factor (subthreshold factor) of 0.1 V/decade. The S-factor is a gate voltage required for changing the drain current by one order of magnitude, and is usually expressed by the following formula:

$$S = d(Vg)/d(\log Id)$$

where Vg represents a gate voltage, log represents a common logarithm and Id represents a drain current. In this case, therefore, intermediate reference voltage Vref0*a* is lowered by 0.1 V, and the drain current changes by one order of magnitude. A current ratio between MOS transistors Q8 and Q9 is equal to 10:1 so that the following formulas are established:

$$I1 = 10 \cdot I2$$

$$I3 = 9 \cdot I2$$

The current flowing through current-mirror-type voltage follower circuit 18 is equal to (I1+I2) so that the following formula is satisfied:

$$I1 + I2 = 11 \cdot I2$$

Therefore, by passing a current, which is about 1.3 (=11/9) times larger than current I3 flowing through resistance dividing unit 19, through current-mirror-type voltage follower circuit 18, it is possible to compensate for lowering of the voltage level of intermediate reference voltage Vref0*a* so that the first and intermediate reference voltages Vref0 and Vref0*a* may attain the same voltage level, in the case where current-mirror-type voltage follower circuit 18 is a ratioless circuit having a gain of 1, MOS transistors Q8 and Q9 have the same size (ratio between the channel width and the channel length), and MOS transistors Q6 and Q7 of the current mirror stage have the same size.

Accordingly, by producing sufficiently small constant current Icst from constant current generating circuit 10, it is possible to lower bias voltage BiasL and to reduce drive current amounts of current-mirror-type voltage follower circuits 18 and 17 so that the current consumption can be reduced.

For adjusting and controlling the temperature characteristic of reference voltage VREF, various methods can be employed. It is now assumed that a current mirror circuit of a threshold voltage differential type is used as constant current generating circuit 10 for producing constant current Icst. In the current mirror circuit of the threshold voltage different differential type, a source of one of MOS transistors, which have different threshold voltages, respectively, is connected to a power supply node, and a source of the other MOS transistor is connected to the power supply node via a resistance element. These MOS transistors in a pair are connected in the current mirror type, and further are connected to the current mirror type current supply. In this structure, constant current Icst is expressed by the following formula:

$$Icst=\Delta Vth/Zr$$

where ΔVth represents a difference in absolute value between the threshold voltages of the current-mirror-type supplying the current to resistance element Zr, and Zr represents a resistance value of the resistance element.

Since the temperature dependence of threshold voltage difference ΔVth is cancelled, constant current Icst provided from constant current generating circuit 10 has temperature dependence caused by resistance value Zr of the resistance element. If this resistance element is made of polycrystalline silicon or diffusion resistance, it has the positive temperature characteristics so that constant current Icst decreases with rising of the temperature. Assuming that MOS transistors Q2-Q5 in reference voltage INV converting circuit 12 has a composite resistance value of ZR, first reference voltage Vref0 is expressed by the following formula:

$$Vref0=\Delta Vth\cdot ZR/Zr$$

In this case, therefore, the value of composite resistance ZR in reference voltage I/V converting circuit 12 may be adjusted to cancel the temperature dependence of resistance ZR and that of resistance Zr with each other, and thereby the temperature characteristic is not particularly adjusted in voltage converting circuit 17. More specifically, the ratioless circuit may be configured such that MOS transistors Q11 and Q12 have the same size, and MOS transistors Q13 and Q14 have the same size, whereby the temperature characteristic is not changed in voltage converting circuit 17. Likewise, the temperature characteristic is not adjusted in intermediate voltage dividing circuit 15 of the resistance division type. Therefore, the temperature characteristics of final reference voltage VREF can be achieved by adjusting the temperature characteristic in reference voltage I/V converting circuit 12. In this case, since first reference voltage Vref0 is set to a voltage level higher than the target voltage, composite resistance ZR of MOS transistors Q2-Q5 can be adjusted with an increased number of MOS transistors Q2-Q5 so that the temperature characteristic can be adjusted with high precision, Also the temperature characteristics of reference voltage I/V converting circuit 12 and voltage converting circuit 17 may be adjusted so that these temperature characteristics may cancel each other. More specifically, the size ratio between MOS transistors Q13 and Q14 is changed in voltage converting circuit 17 (i.e., the ratio is changed) so that final reference voltage VREF contains threshold voltage Vthn of MOS transistors Q13 and Q14 as a voltage level determining factor. This threshold voltage Vthn has a negative temperature factor, and thus the absolute value thereof decreases with increase in temperature. Therefore, even if there is positive temperature dependence in connection with first reference voltage Vref0, the temperature dependence of final reference voltage VREF can be adjusted by utilizing the negative temperature dependence of the voltage generated by voltage converting circuit 17.

For this size adjustment, MOS transistors Q13 and Q14 are formed of unit transistors connected in parallel, respectively, and a fuse element is arranged in a current path of each unit transistor (i.e., is connected in series to each unit transistor) so that it is possible to adjust the number of unit transistors, which can function, and the size ratio between MOS transistors Q13 and Q14 is adjusted.

Constant current generating circuit 10 may be formed of a conventional constant current generating circuit of a threshold voltage reference type, or may be formed of a constant current generating circuit, which is generally utilized in a band gap reference voltage generating circuit. Voltage VII is a stable internal voltage at a voltage level higher than first reference voltage Vref, and is produced by utilizing internal constant current Icst different from external power supply voltage VDDH (=VEX). Accordingly, it is merely required to determine the temperature characteristics of constant current Icst, which is produced according to a compensation manner of the temperature characteristic of the reference voltage, and production of the constant current having no temperature dependence does not cause any particular problem provided that a circuit in a later stage can compensate the temperature characteristic. It is merely required to produce the reference voltage higher than the target voltage level, and thereby to allow the temperature characteristic adjustment even with a low power supply voltage.

According to the first embodiment of the invention, as described above, the reference voltage at the voltage level higher than the target voltage level is produced by using the constant current of the constant current generating circuit, and is divided by resistance division, and then final reference voltage Vref is produced by the voltage follower. Therefore, the temperature characteristic of the first reference voltage at the voltage level higher than the target reference voltage level can be precisely adjusted even with the low power supply voltage, and the reference voltage at the stable voltage level can be produced even with the low power supply voltage. In particular, if the constant current has the temperature characteristic, the temperature characteristic can be adjusted in various manners by using the level converting circuit and the final voltage follower.

Second Embodiment

Figure 4:
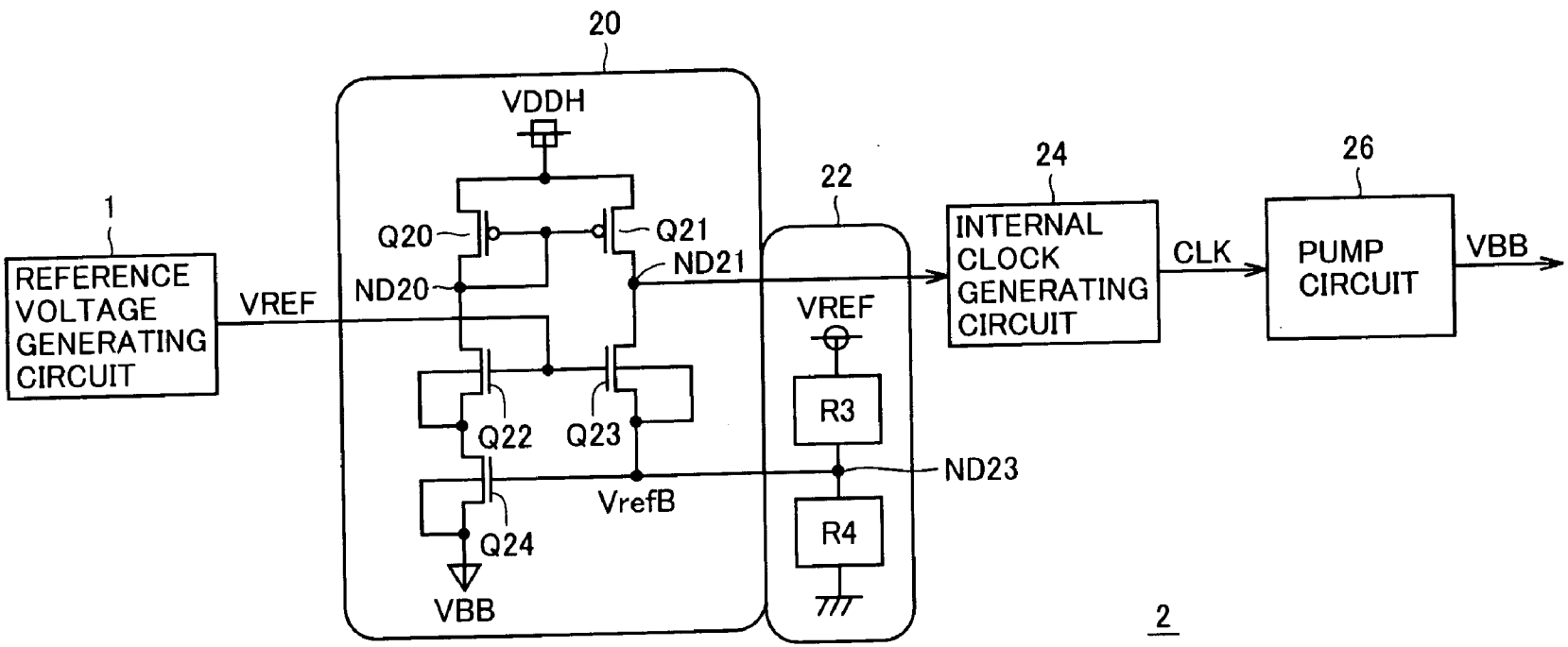
FIG. 4 shows a structure of a negative voltage generating circuit according to a second embodiment of the invention.

FIG. 4 shows a structure of an internal voltage generating circuit according to a second embodiment of the invention. In FIG. 4, a circuit generating negative voltage VBB is shown as internal voltage producing circuit 2. If the corresponding core circuit is a DRAM, negative voltage VBB is applied to a substrate of a memory cell array. In the case of the negative voltage word line structure, negative voltage VBB is transmitted to an unselected word line or selected main word line (in the case of a hierarchical word line structure). In the case of a flash memory, negative voltage VBB is utilized in an erasing or writing operation.

In FIG. 4, internal voltage producing circuit 2 includes a detection level generating circuit 22 of a resistance division type effecting resistance division on reference voltage VREF provided from reference voltage generating circuit 1, a level detecting circuit 20 detecting a level of negative voltage VBB according to a divided voltage VrefB provided from detection level generating circuit 22 of the resistance division type and reference voltage VREF provided from reference voltage generating circuit 1, an internal clock generating circuit 24 selectively producing an internal clock signal CLK according to an output signal of level detecting circuit 20, and a pump circuit 26 producing negative voltage VBB by performing a charge pump operation with a capacitance element according to internal clock signal CLK provided from internal clock generating circuit 24.

Detection level generating circuit 22 of the resistance division type includes resistance elements R3 and R4 connected in series between a node receiving reference voltage VREF and the ground node. Bias voltage VrefB is provided from a connection node ND23 between these resistance elements R3 and R4. Detection level generating circuit 22 of the resistance division type merely divides reference voltage VREF by using the resistance elements, and divided voltage VrefB has the same temperature characteristic as reference voltage VREF. Therefore, if reference voltage VREF is independent of the temperature, bias voltage VrefB is likewise independent of the temperature.

Level detecting circuit 20 includes a P-channel MOS transistor Q20, which is connected between the external power supply node and a node ND20, and has a gate connected to node ND20, a P-channel MOS transistor Q21, which is connected between the external power supply node and node ND2 1, and has a gate connected to node ND20, N-channel MOS transistors Q22 and Q24 connected in series between node ND20 and the negative voltage node, and an N-channel MOS transistor Q23, which is connected between nodes ND21 and ND23, and has a gate receiving reference voltage VREF.

MOS transistor Q22 has a gate receiving reference voltage VREF, and MOS transistor Q24 has a gate receiving bias voltage VrefB.

The external power supply node is supplied with external power supply voltage VDDH (=VEX).

In level detecting circuit 20, MOS transistors Q20 and Q21 form a current mirror circuit to provide a current of the same magnitude from the external power supply node. The currents of the same magnitude flow through MOS transistors Q22 and Q24, respectively. In the case where a gate-source voltage (VrefB−VBB) of MOS transistor Q24 is larger than a gate-source voltage (VREF−VrefB) of MOS transistor Q23, a current flowing through MOS transistor Q24 is larger than that flowing through MOS transistor Q23. Likewise, if a gate-source voltage of MOS transistor Q22 is larger than that of MOS transistor Q23, a current flowing through MOS transistor Q22 is larger than that flowing through MOS transistor Q23. Therefore, if the gate-source voltages of MOS transistors Q22 and Q24 are both larger than the gate-source voltage of MOS transistor Q23, level detecting circuit 20 provides the output signal at the H-level. In the opposite case, level detecting circuit 20 provides the output signal at the L-level. Accordingly, the detection level of negative voltage VBB of level detecting circuit 20 is expressed by the following formula:

$$VREF - VrefB = VrefB - VBB$$

$$VBB = 2 \cdot VrefB - VREF \quad (1)$$

Assuming that detection level generating circuit 22 of the resistance division type has a division ratio of n, bias voltage VrefB is expressed by the following formula:

$$VrefB = n \cdot VREF \quad (2)$$

where $$n = R4/(R3+R4),\ 0<n<1$$

From the foregoing formulas (1) and (2), negative voltage VBB is expressed by the following formula (3):

$$VBB = (2n-1)VREF \quad (3)$$

Accordingly, reference voltage VREF and division ratio n determine the voltage level of negative voltage VBB. Assuming that MOS transistors Q22-Q24 have the threshold voltages of Vthn, a producible voltage range of negative voltage VBB is expressed by the following formula:

$$-VREF < VBB < VrefB - Vthn < VREF - Vthn$$

For providing negative voltage VBB having the temperature characteristic, it is configured to provide reference voltage VREF having the temperature characteristic. Thereby, negative voltage VBB can likewise have the temperature characteristic according to the foregoing formula (3).

The voltage level of negative voltage VBB is set according to a use by adjusting division ratio n in detection level generating circuit 22 of the resistance division type.

Figure 5A:
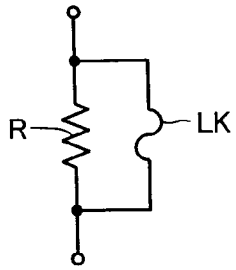
FIGS. 5A and 5B illustrate examples of structures for resistance value tuning of a resistance division circuit.

FIG. 5A shows an example of a structure adjusting the division ratio of detection level generating circuit 22 of the resistance division type. FIG. 5A representatively shows one of unit resistance elements R forming resistance elements R3 and R4. In resistance elements R3 and R4, unit resistance element R is connected in series. A link element LK, which can be blown, is connected in parallel with unit resistance element R. When link element LK is not blown, unit resistance element R is short-circuited to provide a resistance value of zero. When link element LK is blown, unit resistance element R functions to add a resistance value R. Therefore, by selectively blowing or not blowing link element LK, the resistance value of each of resistance elements R3 and R4 can be adjusted, and thereby division ratio n can be adjusted.

Figure 5B:
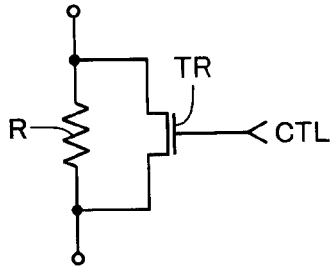

FIG. 5B shows another structure for adjusting the division ratio of detection level generating circuit 22 of the resistance division type. FIG. 5B representatively shows one of unit resistance elements R forming resistance elements R3 and R4. A switching transistor TR receiving a control signal CTL on its gate is connected in parallel with unit resistance element R. An on resistance of switching transistor TR is much smaller than unit resistance element R. Therefore, by selectively turning on/off switching transistor TR according to control signal CTL, it is possible to achieve a state, in which unit resistance element R is added or is eliminated, and thereby the resistance values of resistance elements R3 and R4 can be adjusted.

Control signal CTL may be produced by decoding a signal, which is programmed by a fuse program circuit, or may be stationarily stored in a mode register.

Figure 6:
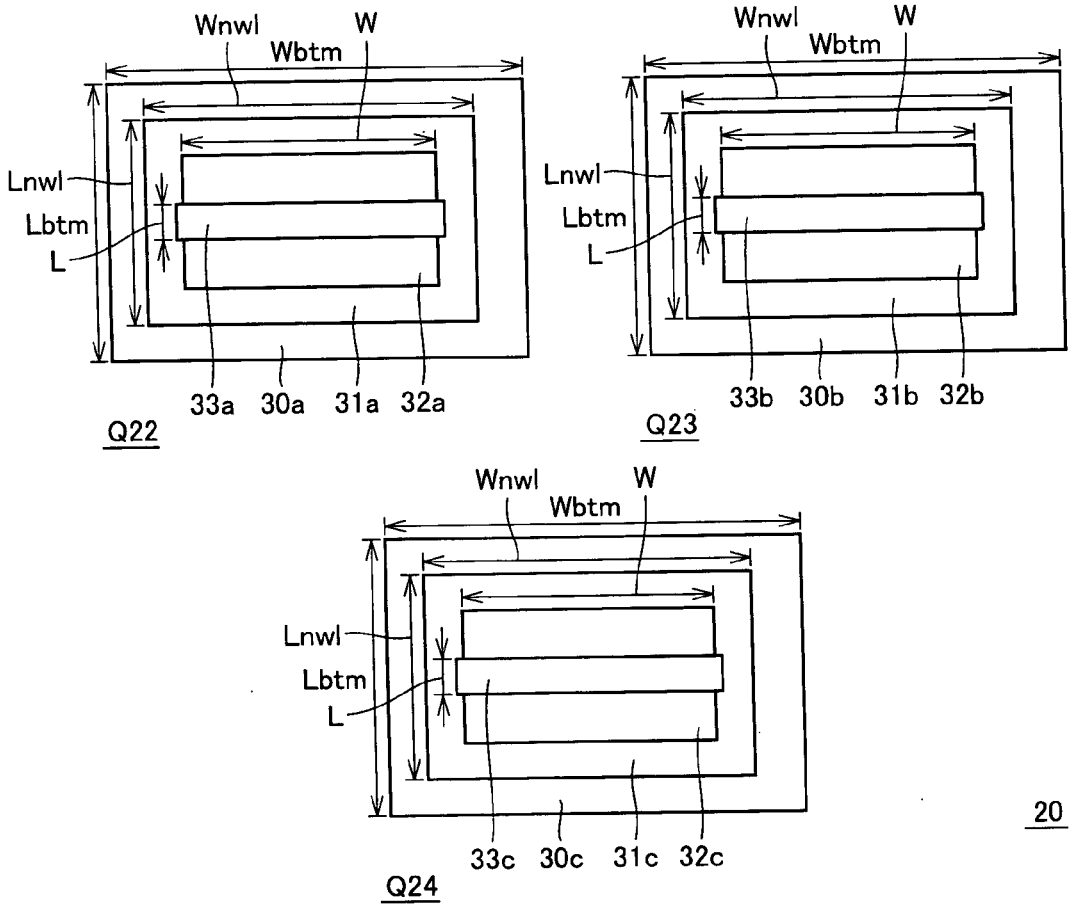
FIG. 6 schematically shows a plan layout of transistors in a level detecting circuit shown in FIG. 4.

FIG. 6 schematically shows a plan layout of MOS transistors Q22-Q24 of level detecting circuit 20 shown in FIG. 4. MOS transistor Q22 is formed at a surface of a P-type well 31*a*, which is formed at a surface of an N-type bottom well 30*a*. MOS transistor Q22 has an active region 32*a* formed at the surface of P-type well 31*a*, and a gate electrode 33*a*, which is formed at a portion of active region 32*a* between source/drain impurity regions, and extends across active region 32*a*. Active region 32*a* includes the source impurity region, the drain impurity region and a channel formation region located under gate electrode 33*a*.

MOS transistor Q23 is likewise formed at a P-type well 31*b* formed at the surface of an N-type bottom well 30*b*. MOS transistor Q23 includes an active region 32*b* formed at the surface of P-type well 31*b* and a gate electrode 33*b*, which extends across active region 32*b*, and is formed between source/drain impurity regions. The source and drain impurity regions are formed on the opposite sides of gate electrode 33*b* of active region 32*b*.

MOS transistor Q24 is likewise formed at a surface of a P-type well 31*c* formed at the surface of an N-type bottom well 30*c*. MOS transistor Q24 includes an active region 32*c* and a gate electrode 33*c*, which extends across active region 32*c*. The source and drain impurity regions are formed on the opposite sides of gate electrode 33*c* of active region 32*c*.

MOS transistors Q22, Q23 and Q24 are isolated from each other by N-type bottom wells 30*a*, 30*b* and 30*c*, and are located at P-type wells 31*a*, 31*b* and 31*c*, respectively. Thereby, the back gate potentials of MOS transistors Q22-Q24 can be different from the source potentials, and the level detection can be performed accurately without causing a substrate effect (i.e., back gate bias effect).

N-type bottom wells 30*a*, 30*b* and 30*c* have the same width Wbtm and the same length Lbtm. P-type wells 31*a*, 31*b* and 31*c* have the same width Wnw1 and the same length Lnw1. Transistors Q22-Q24 have the same channel width of W and the same channel length of L. MOS transistors Q22-Q24 are arranged and aligned in the same direction on the P-type semiconductor substrate. In the plan layout, therefore, transistors Q22-Q24 have layouts shifted parallel to each other, and are influenced by noises applied from the substrate to the same extent.

Figure 7:
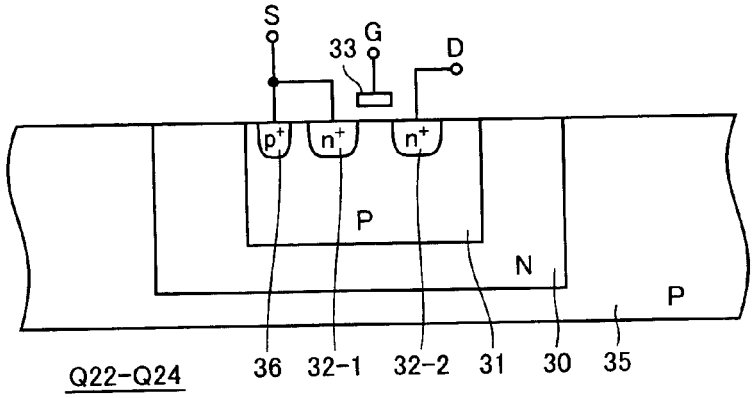
FIG. 7 schematically shows a sectional structure of a transistor shown in FIG. 6.

FIG. 7 schematically shows a sectional structure of each of MOS transistors Q22-Q24 shown in FIG. 6. In FIG. 7, N-type bottom well 30 is formed at a surface of a P-type semiconductor substrate 35, and P-type well 31 is formed at the surface of N-type bottom well 30. N-type impurity regions 32-1 and 32-2 are formed at the surface of P-type well 31, and gate electrode 33 is formed on the channel region between impurity regions 32-1 and 32-2. P-type well 31 forms a back gate of the MOS transistor (Q22-Q24), and is connected to a source node S and impurity region 32-1 via a P-type impurity region 36. Gate electrode 33 is supplied with reference voltage VREF or bias voltage VrefB shown in FIG. 4 via a gate node G, and impurity node 32-2 is connected to a corresponding internal node via a drain node D. The structure shown in FIG. 7 is provided for each of MOS transistors Q22-Q24.

By utilizing N-well 30, each of MOS transistors Q22-Q24 is isolated, and a back gate region (P-well 31) of each of MOS transistors Q22-Q24 is connected to the source region so that the back gate bias effect (substrate effect) can be eliminated.

Since all N-type bottom wells 30 have the same size, all P-type wells 31 have the same size and MOS transistors Q22-Q24 have the same size (ratio between the channel width and the channel length), noises caused by P-type semiconductor substrate 35 affect these MOS transistors Q22-Q24 to the same extent so that influences by noises can cancel each other.

[Modification]

Figure 8:
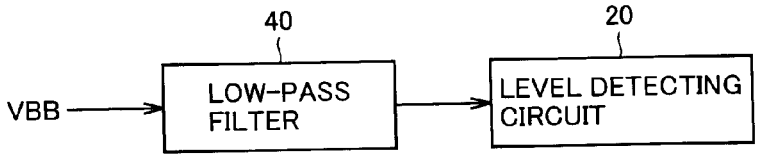
FIG. 8 schematically shows a structure of a modification of a second embodiment of the invention.

FIG. 8 schematically shows a structure of a second modification of the second embodiment of the invention. In the structure shown in FIG. 8, negative voltage VBB is transmitted to level detecting circuit 20 via a low-pass filter 40. Level detecting circuit 20 has the same structure as level detecting circuit 20 shown in FIG. 4. Low-pass filter 40 is formed of a resistance or a capacitance element, and removes variations and noise components in negative voltage VBB. Thereby, level detecting circuit 20 can stably detects the level of negative voltage VBB, and it is possible to prevent unnecessary control of activation/deactivation of the pump operation of pump circuit 26 (see FIG. 4) so that negative voltage VBB can be stably maintained at the desired voltage level.

According to the second embodiment of the invention, as described above, the resistance division of the reference voltage is performed, and the negative voltage generating operation is controlled by detecting the level of the negative voltage based on the reference voltage and the resistance-divided voltage. Therefore, the negative voltage at the desired voltage level having the desired temperature characteristic can be stably produced.

Third Embodiment

Figure 9:
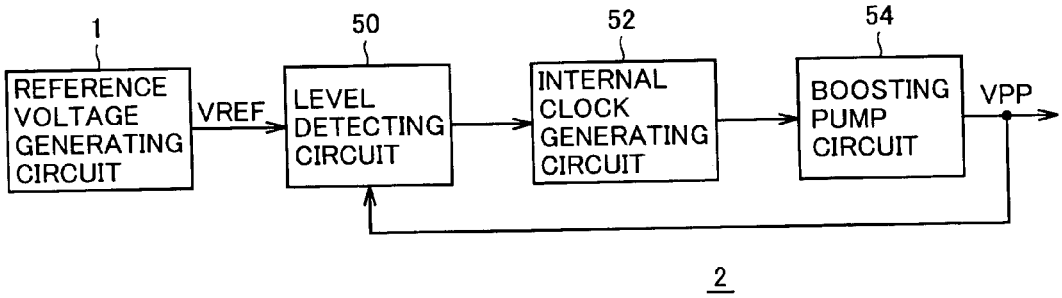
FIG. 9 schematically shows a structure of a boosted voltage generating circuit according to a third embodiment of the invention.

FIG. 9 schematically shows a structure of internal voltage producing circuit 2 according to a third embodiment of the invention. In FIG. 9, internal voltage producing circuit 2 includes a level detecting circuit 50 detecting a level of boosted voltage VPP based on reference voltage VREF provided from reference voltage generating circuit 1, an internal clock generating circuit 52, which is selectively activated according to an output signal of level detecting circuit 50, and thereby generates an internal clock signal of a predetermined period, and a booster pump circuit 54, which produces boosted voltage VPP by utilizing the charge pump operation of the capacitance element according to the internal clock signal provided from internal clock generating circuit 52.

Boosted voltage VPP is at a higher level than externally supplied power supply voltage VDDH (=VEX). The clock signal, which is produced by internal clock generating circuit 52 in the active state, has a high frequency, e.g., of 250 MHz.

Figure 10:
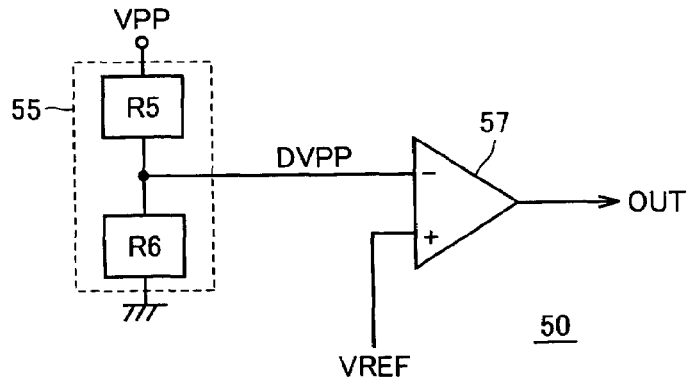
FIG. 10 shows an example of a structure of a level detecting circuit shown in FIG. 9.

FIG. 10 shows an example of a structure of level detecting circuit 50 shown in FIG. 9. In FIG. 10, level detecting circuit 50 includes a resistance division circuit 55, which performs resistance division on boosted voltage VPP, and a comparing circuit 57 comparing an output voltage DVPP of resistance division circuit 55 with reference voltage VREF.

Resistance division circuit 55 includes resistance elements R5 and R6 connected in series between the boosted voltage node and the ground node.

Comparing circuit 57 drives its output signal OUT to the H-level when reference voltage VREF is higher than resistance-divided voltage DVPP, and sets its output signal OUT to the L-level when reference voltage VREF is lower than resistance-divided voltage DVPP.

Assuming that resistance division circuit 55 has the division ratio of 1/m (m>1), the structure shown in FIG. 10 maintains boosted voltage VPP at the voltage level expressed by the following formula:

$$VPP=m\cdot VREF$$

$$1/m=R6/(R5+R6)$$

Therefore, by setting the resistance value between resistance elements R5 and R6 to an appropriate value, it is possible to produce a boosted voltage at the desired voltage level. Since resistance division circuit 55 does not change the temperature characteristic, the boosted voltage thus produced can have substantially the same temperature characteristic as reference voltage VREF. The structures shown in FIGS. 5A and 5B can be utilized for adjusting the resistance division ratio in resistance division circuit 55.

Internal clock generating circuit 52 is formed of, e.g., a ring oscillator, of which oscillation operation selectively becomes active/inactive in accordance with the output signal of level detecting circuit 50.

Figure 11:
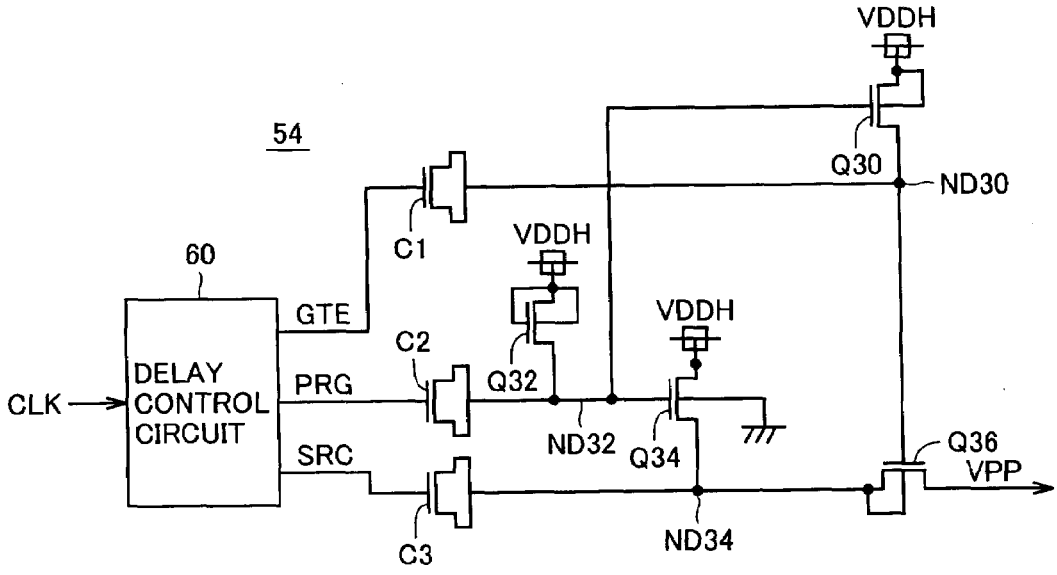
FIG. 11 shows an example of a structure of a booster pump circuit shown in FIG. 9.

FIG. 11 shows a structure of booster pump circuit 54 shown in FIG. 9. In FIG. 11, booster pump circuit 54 includes a delay control circuit 60, which produces three pump control signals GTE, PRG and SRC according to internal clock signal CLK provided from internal clock generating circuit 52, a capacitance element C1, which performs the charge pump operation on a node ND30 according to pump control signal GTE, a capacitance element C2 performing the charge pump operation on a node ND32 according to pump control signal PRG, a capacitance element C3 performing the charge pump operation on a node ND34 according to pump control signal SRC, an N-channel MOS transistor Q30, which is selectively turned on according to the voltage level of node ND32, and thereby transmits external power supply voltage VDDH to node ND30, an N-channel MOS transistor Q32, which is diode connected and clamps the lower limit voltage level of node ND32 at the level of voltage of (VDDH−VTHN), an N-channel MOS transistor Q34, which is selectively turned on according to the voltage level of node ND32, and thereby transmits external power supply voltage VDDH to node ND34, and an N-channel MOS transistor Q36, which is selectively turned on according to the voltage level of node ND30, and thereby transmits positive charges from node ND34 to the output node to produce boosted voltage VPP. The above "VTHN" represents the threshold voltage of MOS transistor Q32.

Each of capacitance elements C1-C3 is formed of a MOS capacitor. Each of capacitance elements C1-C3 has a small gate capacitance for performing a fast charge pump operation, and has a small channel length L, e.g., of 2 μm for rapidly forming a channel. Since each of capacitance elements C1-C3 formed of the MOS capacitors has the channel length of L equal to or smaller than 2 μm, the channel can be formed in response to a fast clock signal, e.g., of about 250 MHz even when the charge pump operation is performed according to such a fast clock signal.

MOS transistor Q34 has a back gate connected to the ground node. Thereby, even when external power supply voltage VDDH further rises during the off state, as will be described later, such a situation can be prevented that the rising of external power supply voltage VDDH is transmitted to node ND34 via MOS transistor Q34 in the off state to raise further the voltage level of boosted voltage VPP.

Figure 12:
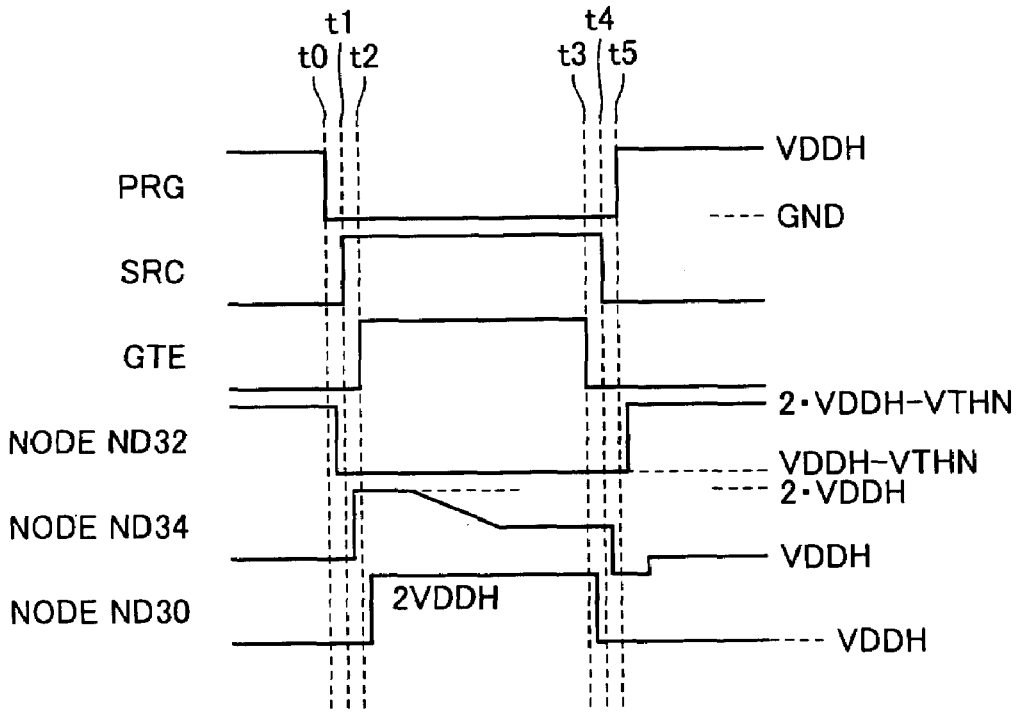
FIG. 12 is a timing chart illustrating an operation of the booster pump circuit shown in FIG. 11.

FIG. 12 is a timing chart illustrating an operation of booster pump circuit 54 shown in FIG. 11. Referring to FIG. 12, an operation of booster pump circuit 54 shown in FIG. 11 will now be described.

Delay control circuit 60 produces pump control signals PRG, SRC and GTE each having an amplitude of VDDH according to internal clock signal CLK provided from internal clock generating circuit 52. Delay control circuit 60 adjusts the delay times with respect to the rising and falling of internal clock signal CLK, and thereby produces pump control signals PRG, SRC and GTE.

At a time t0, pump control signals SRC and GTE are both at the L-level, pump control signal PRG falls from the H-level to the L-level. In response to this falling of pump control signal PRG, the charge pump operation of capacitance element C2 lowers the voltage level of node ND32 by VDDH. However, MOS transistor Q32 maintains this node ND32 at the level of voltage of (VDDH−VTHN).

Although MOS transistor Q32 has the back gate connected to the external power supply node, threshold voltage VTHN is at the voltage level equal to or lower than a forward stepped-down voltage in a PN junction so that electric charges are reliably prevented from flowing out from the back gate of MOS transistor Q32 to node ND32.

Pump control signals SRC and GTE are both at the L-level, and nodes ND34 and ND30 are maintained at the level of external power supply voltage VDDH, which was already precharged at the end of the last cycle.

When the voltage level of node ND32 lowers to the voltage of (VDDH−VTHN), MOS transistor Q30 is turned off. Likewise, MOS transistor Q34 is turned off.

At a time t1, when pump control signal SRC rises from the L-level to the H-level, the charge pump operation of capacitance element C3 raises the voltage level of node ND34 to a voltage level of (2·VDDH) higher than voltage VDDH.

At a time t2, pump control signal GTE rises to the H-level. Thereby, the charge pump operation of capacitance element C1 changes the voltage level of node ND30 from voltage VDDH to the high voltage of (2·VDDH) so that MOS transistor Q36 is turned on to transmit positive charges from node ND34 to the output node. According to this movement of the positive charges, the voltage level of node ND34 lowers, and the movement of positive charges will stop when the voltage level of the output node becomes equal to the voltage level of node ND34.

At a time t3, pump control signal GTE falls from the H-level to the L-level, and the charge pump operation of capacitance element C1 lowers the voltage level of node ND30 from the high voltage of (2·VDDH) to voltage VDDH so that MOS transistor Q36 is turned off.

At a time t4, pump control signal SRC lowers from the H-level to the L-level, and the charge pump operation of capacitance element C3 lowers the voltage level of node ND34 by a magnitude of voltage VDDH.

At a time t5, when pump control signal PRG rises to the H-level, the charge pump operation of capacitance element C3 raises the voltage level of node ND32 to the voltage level of (2·VDDH−VTHN), and MOS transistors Q30 and Q34 are turned on so that nodes ND30 and ND34 are precharged to the level of external power supply voltage VDDH.

Thereafter, a series of the above operations is repeated so that the voltage at the level of up to (2·VDDH−VTHN) can be generated as boosted voltage VPP, where VTHN represents a threshold voltage of MOS transistor Q36.

Figure 13:
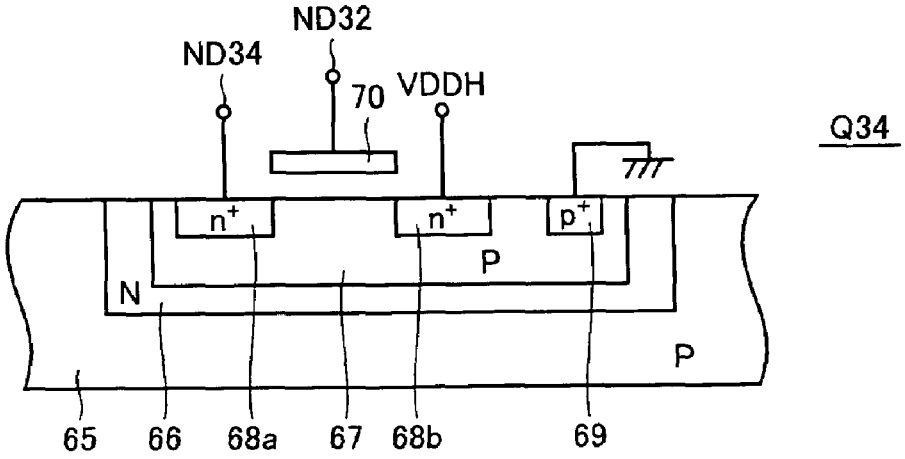
FIG. 13 schematically shows a sectional structure of a transistor for precharging a boost node shown in FIG. 11.

FIG. 13 schematically shows a sectional structure of MOS transistor Q34 shown in FIG. 11. In FIG. 13, MOS transistor Q34 is formed at a P-type well 67 in an N-type bottom well 66 formed at the surface of a semiconductor substrate 65. MOS transistor Q34 includes N-type impurity regions 68*a* and 68*b* formed at the surface of P-type well 67 with a space therebetween, and a gate electrode 70 formed on a region between impurity regions 68*a* and 68*b*. P-type well 67 is coupled to the ground node via a P-type impurity region 69 formed at the surface of P-type well 67. Thus, MOS transistor Q34 has the back gate connected to the ground node.

Impurity region 68*b* is connected to the external power supply node (VDDH), gate electrode 70 is connected to node ND32, and impurity region 68*a* is connected to node ND34.

P-type well 67 is connected to the ground node so that impurity region 68*b* and P-type well 67 are in the reversely biased state, and a nonconductive state is always kept between impurity region 68*b* and P-type well 67. Therefore, even if the voltage level of external power supply voltage VDDH rises when node ND32 is at the voltage level of (VDDH−VTH) and MOS transistor Q34 is off, it is possible to prevent transmission of external power supply voltage VDDH to node ND34.

More specifically, if voltage VDDH on the external power supply node rises due to the influence of noises or the like when impurity region 68*b* is connected to external power supply node VDDH, the PN junction between P-type well 67 and impurity region 68*a* enters the forward bias state even when MOS transistor Q34 is off. Thereby, the raised voltage level of external power supply voltage VDDH is transmitted to node ND34 to raise the voltage level of node ND34. After the voltage level of node ND34 rises due to noise components, the charge pump operation may be effected on node ND34 according to pump control signal SRC. In this case, the voltage level of node ND34 further rises so that the voltage level of boosted voltage VPP rises.

Boosted voltage VPP is transmitted, e.g., to a word line drive circuit in a memory circuit (in the case of a DRAM). In this state, the level of the voltage applied to the MOS transistor in the word line drive circuit may rise to cause dielectric breakdown in the MOS transistor. Particularly, when the voltage level of boosted voltage VPP is raised, e.g., in an acceleration test, the voltage level of external power supply voltage VDDH rises and attains a further raised level. In the acceleration test, therefore, noises or the like on the external power supply node may raise the voltage level of boosted voltage VPP to cause the dielectric breakdown of the MOS transistor. By connecting the back gate of MOS transistor Q34, which is provided for precharging the internal node, to the ground node, it is possible to prevent reliably the transmission of the voltage rising, which is caused by such noises or the like in external power supply voltage VDDH, to the internal node.

[Modification]

Figure 14:
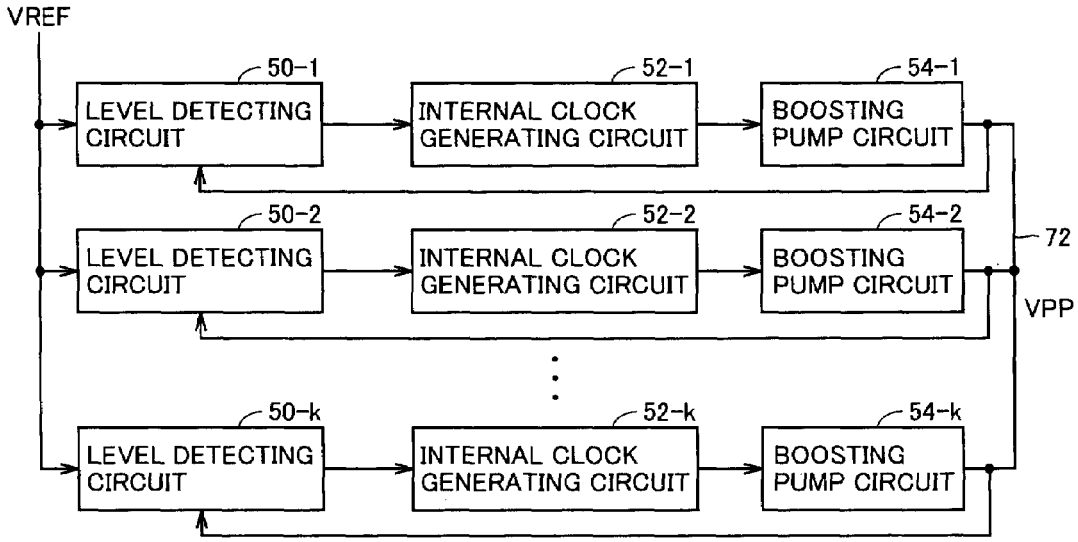
FIG. 14 schematically shows a structure of a modification of the third embodiment of the invention.

FIG. 14 schematically shows a structure of a modification of the internal voltage producing circuit according to the third embodiment of the invention. In FIG. 14, booster pump circuits 54-1-54-k are arranged in parallel, and all are connected to a boosted voltage transmission line 72. Corresponding to booster pump circuits 54-1-54-k, level detecting circuits 50-1-50-k are arranged, respectively. Internal clock generating circuits 52-1-52-k are arranged corresponding to level detecting circuits 50-1-50-k, respectively. Common reference voltage VREF is supplied to level detecting circuits 50-1-50-k.

Booster pump circuits 54-1-54-k have the same structure as booster pump circuit 54 shown in FIG. 11. Level detecting circuits 50-1-50-k have substantially the same structure as level detecting circuit 50 shown in FIG. 10. Internal clock generating circuits 52-1-52-k have substantially the same structure as internal clock generating circuit 52, and are formed of, e.g., ring oscillators.

In the structure shown in FIG. 14, a plurality of modules, each of which is formed of level detecting circuit 50, internal clock generating circuit 52 and booster pump circuit 54 shown in FIG. 9, are arranged in parallel. Even if internal clock signals produced by internal clock generating circuits 52-1-52-k are fast pump clock signals, the whole system of the boosted voltage generating circuit achieves fast response. More specifically, level detecting circuits 50-1-50-k detect the voltage levels of the output nodes of corresponding booster pump circuits 54-1-54-k, respectively, and the clock generating operations of internal clock generating circuits 52-1-52-k are controlled based on the results of the detection. As compared with a structure, in which a plurality of booster pump circuits are provided for one level detecting circuit and one internal clock generating circuit, it is possible to reduce an interconnection capacitance and to increase a response speed in the pump operation control. Further, it is possible to reduce interconnection lengths from level detecting circuits 50-1-50-k to corresponding booster pump circuits 54-1-54-k so that the response time can be reduced.

Level detecting circuits 50-1-50-k are supplied with reference voltage VREF from common reference voltage generating circuit 1, and the level detection of boosted voltage VPP is performed based on reference voltage VREF.

[Modification 2]

Figure 15:
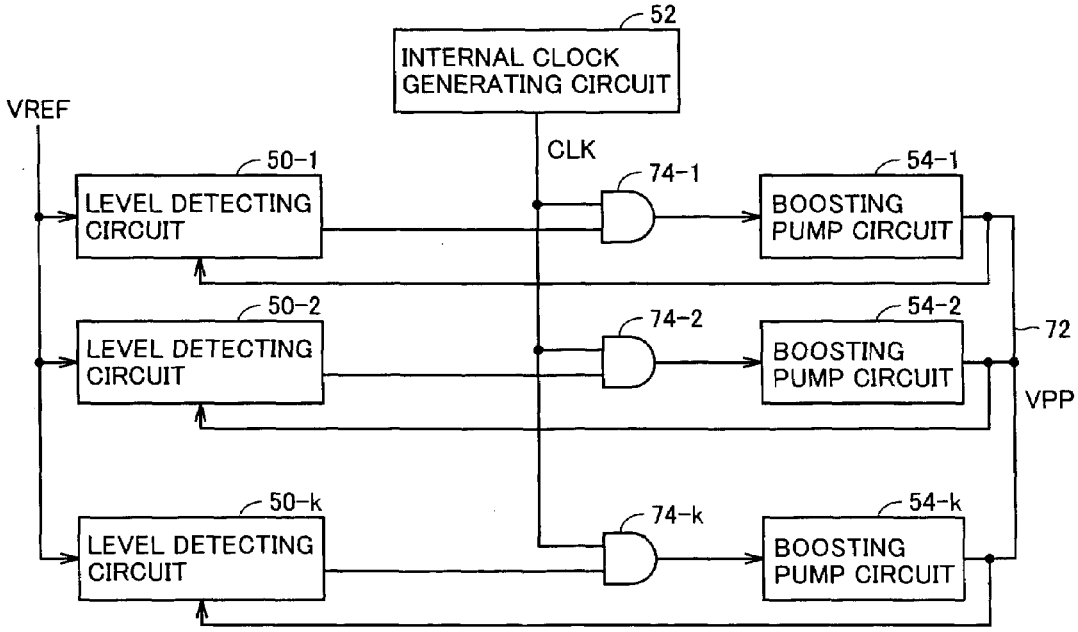
FIG. 15 schematically shows a structure of a second modification of the third embodiment of the invention.

FIG. 15 schematically shows a structure of a boosted voltage generating circuit according to a modification 2 of the third embodiment of the invention. In FIG. 15, gate circuits 74-1-74-k, which receive internal clock signal CLK of internal clock generating circuit 52 and output signals of corresponding level detecting circuits 50-1-50-k, are arranged between level detecting circuits 50-1-50-k and corresponding booster pump circuits 54-1-54-k, respectively. According to the output signals of gate circuits 74-1-74-k, the pump operations in corresponding booster pump circuits 54-1-54-k are controlled, respectively. Other structures of the boosted voltage generating circuit shown in FIG. 15 are the same as those shown in FIG. 14. Corresponding portions bear the same reference numbers, and description thereof is not repeated.

In the structure of FIG. 15, only gate circuits 74-1-74-k forming one stage are arranged between level detecting circuits 50-1-50-k and corresponding boosted pump circuits 54-1-54-k, respectively, so that it is possible to achieve fast response of the pump operation with respect to the level detection of boosted voltage VPP, and activation/deactivation of the pump operation can be controlled fast according to the result of the level detection.

In the structure shown in FIG. 15, internal clock generating circuit 52 is arranged commonly to booster pump circuits 54-1-54-k. If long interconnections used for transmitting internal clock signal CLK from internal clock generating circuit 52, a repeater receiving internal clock signal CLK may be arranged on the clock signal line. Thereby, the pump clock signal can be accurately transmitted to each of gate circuits 74-1-74-k without dulling the waveform of internal clock signal CLK.

According to the third embodiment of the invention, the pump capacitor of the pump circuit producing the boosted voltage has a reduced channel length, and the MOS transistor for precharging the boosted voltage node has the back gate connected to the ground node so that boosted voltage VPP at the desired voltage level can be stably produced according to the fast pump clock signal.

The level detecting circuit and the booster pump circuit are arranged in a one-to-one relationship so that fast response can be achieved in the response operation control with respect to the level detection, and the operation can be performed with the fast clock signal to maintain boosted voltage VPP at the desired voltage level.

Fourth Embodiment

Figure 16:
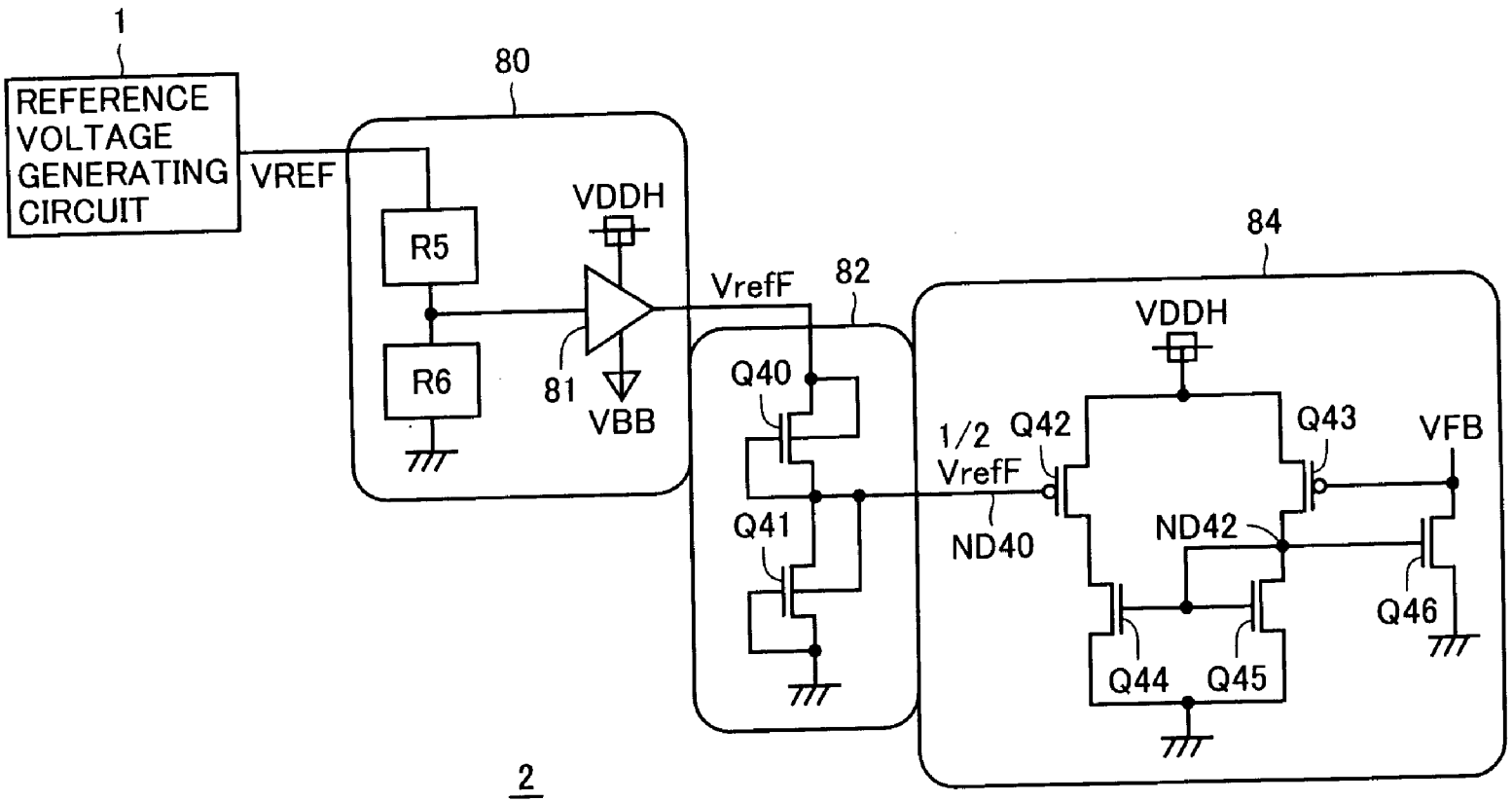
FIG. 16 shows a structure of a low voltage generating circuit according to a fourth embodiment of the invention.

FIG. 16 shows an example of a structure of an internal voltage producing circuit according to a fourth embodiment of the invention. In FIG. 16, internal voltage producing circuit 2 includes a voltage dividing circuit 80, which divides reference voltage VREF provided from reference voltage generating circuit 1 to produce a reference voltage VrefF in a range from 0.6 V to 1.2 V, a voltage dividing circuit 82 further dividing reference voltage VrefF provided from dividing circuit 80, and a drive circuit 84 producing a low voltage VFB according to an output voltage Vref/2 of voltage dividing circuit 82. Low voltage VFB is in a range from 0.3 V to 0.6 V.

Voltage dividing circuit 80 includes resistance elements R5 and R6, which receive reference voltage VREF and are connected in series, and an analog buffer 81, which produces reference voltage VrefF by buffering the voltage on a connection node between resistance elements R5 and R6. Analog buffer 81 utilizes external power supply voltage VDDH and negative voltage VBB as operation power supply voltages. Thereby, even when reference voltage VrefF is low and equal to, e.g., 0.4 V, internal transistors in analog buffer 81 can reliably and stably operate. A voltage follower, which is formed of a differential amplifier circuit of the current mirror type and has a gain equal to one, may be used as analog buffer 81.

Voltage dividing circuit 82 has an N-channel MOS transistor Q40, which receives reference voltage VrefF on one of its conduction nodes and its back gate, and has a gate and the other conduction node connected to a node ND40, and an N-channel MOS transistor Q41, which is connected between node ND40 and the ground node, and has a gate connected to the ground node as well as a back gate connected to node ND40.

MOS transistors Q40 and Q41 have thin gate insulating films, and have voltages of a sufficiently low value.

In MOS transistors Q40 and Q41, each back gate is set to a higher voltage level than the source so that threshold voltages of MOS transistors Q40 and Q41 can be further reduced. In this state, MOS transistors Q40 and Q41 are in the positive back gate bias state, and the current flowing therethrough can be larger than those in the state, where the bias voltage applied to the back gate is at the negative or ground voltage level, under then same drain voltage conditions, even if gate-source voltage Vgs is 0 V. The current in this state is a subthreshold current, and is extremely small. In this state, MOS transistors Q40 and Q41 have the same resistance value in channel regions, which are in a weakly inverted state. Therefore, a voltage of ((½)VrefF) produced by multiplying reference voltage VrefF by ½ can be stably obtained from reference voltage VrefF at the low voltage level with small current consumption.

If reference voltage VrefF is, e.g., in a range from 0.6 V to 1.2 V, MOS transistors Q40 and Q41 have the back gate bias voltages in a range from 0.3 V to 0.6 V, and the PN junction between each back gate and the impurity region exhibits a forward stepped-down voltage, e.g., of 0.6 V so that the sufficient off state is maintained.

Drive circuit 84 has a P-channel MOS transistor Q42, which is connected between the external power supply node and a node ND41, and has a gate connected to node ND40, a P-channel MOS transistor Q43, which is connected between the external power supply node and a node ND42, and has a gate receiving low voltage VFB, an N-channel MOS transistor Q44, which is connected between node ND41 and the ground node, and has a gate connected to node ND42, an N-channel MOS transistor Q45, which is connected between node ND42 and the ground node, and has a gate connected to node ND42, and an N-channel MOS transistor Q46, which is connected between the low voltage output node and the ground node, and has a gate connected to node ND42.

The low voltage output node is connected to a current supply or a resistance element, which is formed of, e.g., a resistance-connected P-channel MOS transistor (not shown), and is supplied with a current from the power supply node. MOS transistor Q46 functions as a current-to-voltage converter element.

In drive circuit 84, MOS transistors Q42 and Q43 compare divided voltage VrefF/2 and low voltage VFB with each other. When low voltage VFB is at a higher level than voltage VrefF/2, the amount of current flowing through MOS transistor Q43 lowers so that the amount of current flowing through MOS transistor Q45 lowers. Thereby, the amount of current flowing through MOS transistor Q46 lowers, and the drain-source voltage lowers. Therefore, the drain potential of MOS transistor Q46 and thus low voltage VFB lower.

Conversely, when low voltage VFB is lower than voltage VrefF/2, the amount of the current flowing through MOS transistor Q43 increases so that the amount of the current flowing through MOS transistor Q45 increases. Thereby, the voltage level of node ND42 rises so that the amount of the current flowing through MOS transistor Q46 increases, and the drain voltage of MOS transistor Q46, i.e., low voltage VFB increases. Thereby, low voltage VFB can be accurately maintained at the voltage level of the target voltage VrefF/2.

In voltage dividing circuit 80, reference voltage VrefF is produced without changing the temperature characteristic of reference voltage VREF. In voltage dividing circuit 82, target voltage VrefF/2 is likewise produced without changing the temperature characteristic of reference voltage VrefF. Therefore, low voltage VFB having the same temperature characteristic as reference voltage VREF can be stably produced even with a low power supply voltage.

Fifth Embodiment

Figure 17:
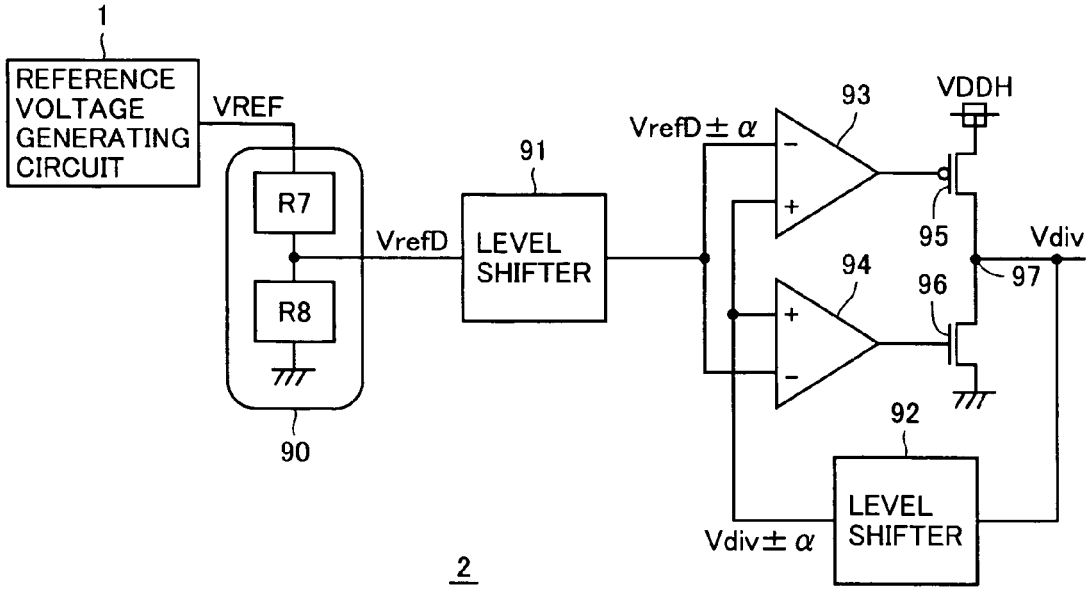
FIG. 17 shows a structure of a divided voltage generating circuit according to a fifth embodiment of the invention.

FIG. 17 schematically shows a structure of internal voltage producing circuit 2 according to a fifth embodiment of the invention. In FIG. 17, internal voltage producing circuit 2 includes a resistance division circuit 90 dividing reference voltage VREF, a level shifter 91 shifting a reference voltage VrefD, which is produced by resistance division circuit 90, by a predetermined value of ±α, a level shifter 92 shifting final divided voltage Vdiv by the predetermined value of ±α, comparing circuits 93 and 94 comparing the output voltages of level shifters 91 and 92, respectively, a P-channel MOS transistor 95, which supplies a current from the external power supply node to an output node 97 according to the output signal of comparing circuit 93, and an N-channel MOS transistor 96, which discharges a current from output node 97 to the ground node according to the output signal of comparing circuit 94.

Resistance division circuit 90 includes resistance elements R7 and R8 connected in series, and produces reference voltage VrefD by performing the voltage dividing operation according to a resistance ratio between resistance elements R7 and R8. In resistance division circuit 90, the resistance values of resistance elements R7 and R8 are adjustable (see FIGS. 5A and 5B).

Level shifters 91 and 92, of which structures will be described later in detail, are formed of MOS transistors having thick gate insulating films, and these MOS transistors have the threshold voltages of relatively large absolute values. The level shift operations of level shifters 91 and 92 adjust the levels of voltages applied to comparing circuits 93 and 94, and thereby comparing circuits 93 and 94 can operate in a range of the highest sensitivity even when a voltage Vdiv thus produced is close to the detection limit of comparing circuits 93 and 94 (i.e., close to the threshold voltage of differential stage transistor). Thereby, the voltage level of reference voltage VrefD can be accurately set to the desired voltage level. Assuming that resistance division circuit 90 has a division ratio of n (0<n<1), reference voltage VrefD is expressed by the following formula:

$$VrefD = n \cdot VREF$$

According to the target voltage level, comparing circuits 93 and 94 selectively utilizes a structure, in which the differential stage is formed of the P-channel MOS transistors shown in FIG. 16, and a structure, in which the differential stage is formed of the N-channel MOS transistors shown in FIG. 3.

When output voltage (Vdiv±α) of level shifter 92 is higher than output voltage (VrefD±α) of level shifter 91, comparing circuit 93 turns off MOS transistor 95. In the opposite case, comparing circuit 93 increases a conductance of MOS transistor 95 to raise the voltage level of divided voltage Vdiv. Likewise, when output voltage (Vdiv±α) of level shifter 92 is higher than output voltage (VrefD±α) of level shifter 91, comparing circuit 94 increases a conductance of MOS transistor 96 to discharge the current from output node 97 to the ground node, and thereby lowers the voltage level of divided voltage Vdiv. When output voltage (Vdiv±α) of level shifter 92 is lower than output voltage (VrefD±α) of level shifter 91, comparing circuit 94 turns off MOS transistor 96.

Therefore, when the shift amounts of level shifters 91 and 92 are equal to each other, divided voltage Vdiv is maintained at the level of reference voltage Vref1). Thus, divided voltage is expressed by the following formula:

$$Vdiv = VrefD = n \cdot VREF$$

When the level shift amounts of level shifters 91 and 92 are different from each other, divided voltage Vdiv satisfies a relationship expressed by the following formula with respect to the reference voltage:

$$Vdiv = n \cdot VREF - \beta$$

where β represents a difference between the shift voltages of level shifters 91 and 92.

Resistance division circuit 90 has division ratio n, which is adjusted for adjusting the voltage level of reference voltage VrefD. Similarly to the first embodiment, the adjustment of division ratio n is achieved by adjusting the resistance values of resistance elements R7 and R8 in a manner, e.g., using a fuse program.

Figure 18A:
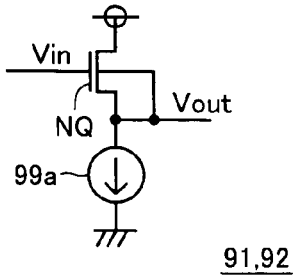
FIGS. 18A and 18B show a structure of a level shifter shown in FIG. 17.

FIG. 18A shows an example of a structure of level shifters 91 and 92. In FIG. 18A, the level shifter includes an N-channel MOS transistor NQ, which is connected between the power supply node and the output node, and has a gate receiving an input voltage Vin, and a current supply 99*a* connected between the output node and the ground node. MOS transistor NQ operates in a source follower mode to set output voltage Vout to a voltage level expressed by the following formula:

$$Vout = Vin - VTHN$$

MOS transistor NQ has a thick gate insulating film, and has threshold voltage VTHN, which can be set to a relatively large value. By adjusting threshold voltage VTHN, the voltage level of output voltage VOUT can be set in a relatively large range.

Figure 18B:
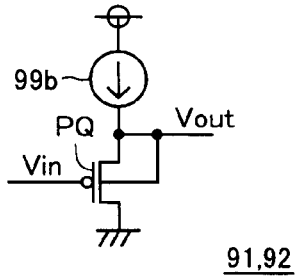

FIG. 18B shows another structure of level shifters 91 and 92. In FIG. 18B, the level shifter (91, 92) includes a current supply 99b, which is connected between the power supply node and the output node, and a P-channel MOS transistor PQ, which is connected between the output node and the ground node, and has a gate receiving input voltage Vin. This P-channel MOS transistor PQ likewise operates in a source follower mode, and maintains output voltage Vout at the voltage level expressed by the following formula:

$$Vout = Vin + VTHP$$

where VTHP represents an absolute value of the threshold voltage of MOS transistor PQ.

MOS transistor PQ likewise has a thick gate insulating film, and the threshold voltage thereof can be set to a relatively desired range. By appropriately combining N- and P-channel MOS transistors NQ and PQ for use, comparing circuits 93 and 94 can perform the comparing operation on reference voltage VrefD and divided voltage Vdiv with the range set to achieve high appropriate sensitivity, and the final divided voltage can be maintained at the desired target voltage level.

Figure 19:
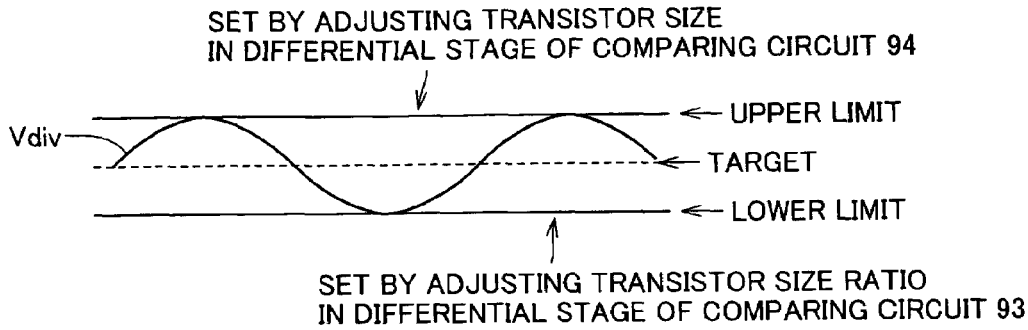
FIG. 19 schematically illustrates a control range of an output voltage of the divided voltage generating circuit shown in FIG. 17.

FIG. 19 schematically illustrates an insensitive band of divided voltage Vdiv shown in FIG. 17. In the actual operation, divided voltage Vdiv is allowed to vary between upper and lower limit values shifted from an ideal value of (n·VrefD). When the voltage level is kept between these upper and lower limit values, both MOS transistors 95 and 96 are kept off. Thereby, such a situation is prevented that MOS transistors 95 and 96 are unnecessarily turned on/off to consume the currents. The upper limit value depends on the output signal of comparing circuit 94, and the lower limit value depends on the output signal of comparing circuit 93. For adjusting these upper and lower limit values, size ratios (ratios of channel widths and channel lengths) of the MOS transistors in the differential stage of comparing circuits 93 and 94 are adjusted so that the insensitive band can be adjusted to the appropriate range.

According to the fifth embodiment of the invention, as described above, the resistance division is effected on the reference voltage, and the level shifters shift the divided voltage and the reference voltage. Then, the comparing circuits perform the comparing operation to adjust the voltage level of the divided voltage. Therefore, even in the case of producing the divided voltage near the detection level limit of the comparing circuits (93, 94) (i.e., near the threshold voltage level of the transistor), the comparing operation can be performed accurately and stably to produce the divided voltage at the desired voltage level.

Sixth Embodiment

Figure 20:
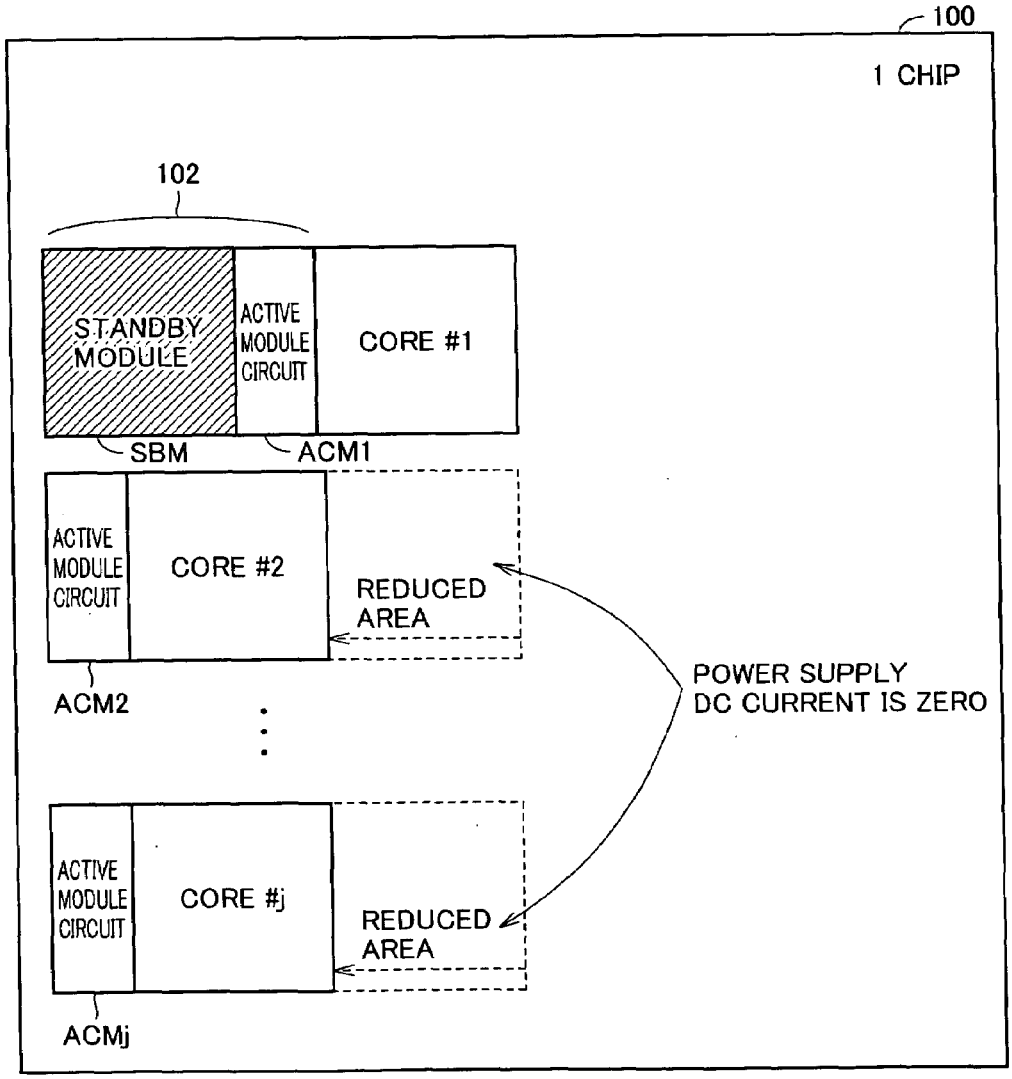
FIG. 20 schematically shows a chip layout of a semiconductor integrated circuit device according to a sixth embodiment of the invention.

FIG. 20 schematically shows an arrangement of a power supply in a semiconductor integrated circuit device according to a sixth embodiment of the invention. In FIG. 20, the semiconductor integrated circuit device includes a plurality of cores #1-#j arranged on a semiconductor chip 100. These cores #1-#j include memory circuits such as a logic, DRAM, SRAM and/or flash memory, and achieve predetermined functions, respectively.

For core #1, a power supply circuit 102 is arranged. Power supply circuit 102 includes a standby module SBM and an active module circuit ACM1 (i.e., a circuit relative to an active module). If standby module SBM is a reference voltage generating circuit, a constant current generating circuit or a DRAM, it includes a circuit generating a substrate bias voltage VBB, a circuit generating a bit line precharge voltage VHF or the like, and thus includes a first current consumption circuit, which always operates in standby cycles and active cycles to produce the voltage or current with small current consumption. Cores #1-#j commonly utilize the voltage produced by standby module SBM.

Each of active module circuits ACM1-ACMj includes the active module including a circuit, which operates with second current consumption larger than the first current consumption, and produces a voltage consumed during the active cycle of the corresponding core, as well as a control circuit, which adjusts the level of the voltage produced by the voltage generating circuit in this active module, and performs operation control of the circuit. If the active module is, e.g., a DRAM, the active module includes a circuit generating boosted voltage VPP and an internal voltage down converter circuit producing the internal power supply voltage. The control circuit includes a level detecting circuit detecting the level of the generated voltage, a clock generating circuit producing a clock signal for the pump according to the output signal of the level detecting circuit and a circuit controlling activation/deactivation of the internal voltage down converter circuit. This active module may be kept inactive during the standby state according to an operation cycle instructing signal.

By provision of active module circuits ACM1-ACMj in respective cores #1-#j, the voltage level required for each core is set to the optimum value. The voltage generating circuits in these standby module and active modules are selectively formed of the circuits already described in connection with the first to fifth embodiments.

In the structure shown in FIG. 20, standby module SBM is provided commonly to cores #1-#j, and cores #1-#j commonly utilize the reference voltage and the constant current produced by standby module SBM. Therefore, it is not necessary to provide independent standby module SBM for each core, and thus a required area can be small. Further, when a tuning test is performed for setting the voltage level during adjustment of the voltage level, only one standby module SBM operates, and it is not necessary to conduct the tuning test on the voltage level produced by the standby module in each core so that the time can be reduced.

A test for a standby current, i.e., a current consumed in the standby cycle is likewise required for only standby module SBM provided for core #1 so that the test time for the standby current (standby DC current) can be reduced. Standby module SBM is provided only in power supply circuit 102 for core #1. Only standby module SBM is the circuit operating in the standby cycle, and the current (power supply DC current) used during the standby can be reduced. Thus, cores #2-#j do not consume the current during the standby, the power supply DC current does not flow so that the current consumption of semiconductor integrated circuit device 100 can be reduced in the standby state.

Figure 21:
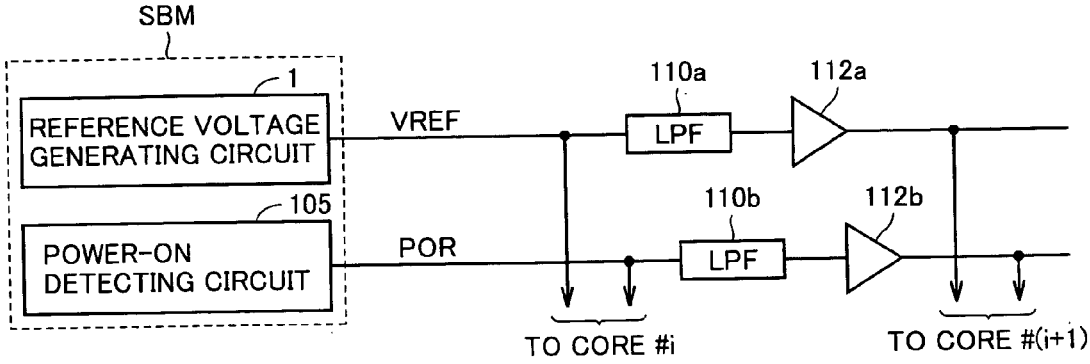
FIG. 21 schematically shows a structure of voltage transmission lines of the semiconductor integrated circuit device according to the sixth embodiment of the invention.

FIG. 21 shows an example of an arrangement of interconnections arranged between the cores for transmitting the internal voltage form the standby module. FIG. 21 representatively shows, as circuits in standby module SBM, reference voltage generating circuit 1 and a power-on detecting circuit 105, which detects supply of external power supply voltage (VDDH). Reference voltage VREF and a power-on detection signal POR are transmitted to each of circuits in cores #1-#j and active module circuits ACM2-ACMi shown in FIG. 20.

Since the interconnection length is large, the interconnection unit between the cores is provided with low-pass filters (LPF) 110*a* and 110*b* for reducing noises as well as analog buffers 112*a* and 112*b* for achieving rapid rising of the voltage. FIG. 21 shows the low-pass filters and the analog buffers provided on the interconnection unit between cores #1 and #(i+1). These low-pass filters and the analog buffers are arranged in a portion between each of cores #2-#j and the neighboring core. Thereby, even in the case of arranging standby module SBM only in core #1, it is possible to transmit stably the voltages such as reference voltage VREF and power-on detection signal POR, which are produced by standby module SBM, to each of cores #2-#j.

The low-pass filter and the analog buffer are likewise provided for output voltages of other circuits, i.e., a negative voltage generating circuit and an intermediate voltage generating circuit included in standby module SBM. According to the voltage transmission characteristics of the interconnections, only the low-pass filter or the analog buffer may be arranged for each voltage.

[Modification 1]

Figure 22:
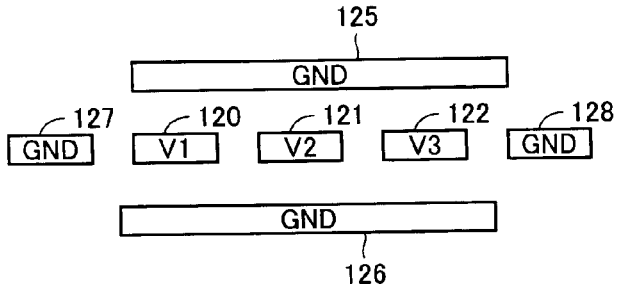
FIG. 22 schematically shows a structure of a shield structure of the voltage transmission lines according to the sixth embodiment of the invention.

FIG. 22 schematically shows an arrangement of interconnections according to a modification 1 of the sixth embodiment of the invention. In FIG. 22, voltage transmission lines 120, 121 and 122 are arranged for transmitting voltages V1, V2 and V3 from standby module SBM, respectively. FIG. 22 shows an example, in which these voltage transmission lines 120-122 are formed in the same layer. These voltage transmission lines 120-122 are arranged between interconnections 127 and 128, which are fixed to a ground voltage GND, and are formed at the same layer as voltage transmission lines 120-122. Also, interconnections 125 and 126 kept at ground voltage GND are arranged at the upper and lower layers, respectively.

Interconnections 125-128, which are arranged on the vertically and laterally opposite sides, shield voltages V1-V3 transmitted from standby module SBM, and suppress the influence of noises for stably transmitting the voltages from standby module SBM. Voltages V1-V3 are, e.g., a reference voltage, a voltage for reference produced by the resistance division of the standard voltage, an intermediate voltage and a negative voltage, and these voltages are produced by standby module SBM for transmission to the respective cores.

As shown in FIG. 22, the voltage transmission lines transmitting the voltages from the standby module are surrounded by the interconnections, which are arranged on the vertically and laterally opposite sides, and are kept at the fixed voltage such as the ground voltage. The voltage transmission lines can stably transmit the voltages from the standby mode to the respective cores. Since the interconnections for the reference voltage, the voltage for reference and others are all handled as a single group for shielding them, the shield interconnections occupy a smaller area than a structure, in which lines transmitting voltages produced by respective standby modules are shielded independently of each other. Instead of arranging the shield interconnections on all the laterally and vertically opposite sides of the voltage transmission lines, the shield line(s) may be arranged at one or some appropriate positions on one or some of the above four sides.

[Modification 2]

Figure 23:
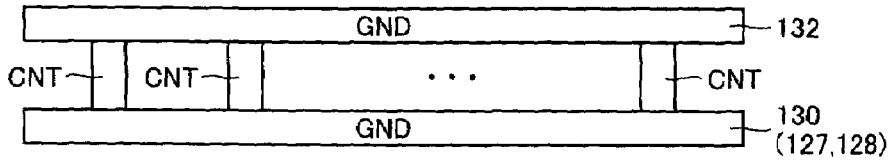
FIG. 23 shows a modification of the shield structure of the voltage transmission lines according to the sixth embodiment of the invention.

FIG. 23 schematically shows an arrangement of the voltage transmission lines according to a modification 2 of the sixth embodiment of the invention. In FIG. 23, a shield interconnection 130 corresponding to shield interconnection 127 or 128 shown in FIG. 22 has a plurality of portions, which are electrically connected to an interconnection 132 at the upper layer via contacts CNT, respectively. Upper interconnection 132 may be the same as upper interconnection 125 for the shield purpose shown in FIG. 22, or may be different therefrom. These interconnections 130 and 132 are fixed at the level of ground voltage GND.

Shield interconnections 130, which are arranged on the laterally opposite sides of voltage transmission lines 120-122 shown in FIG. 22, are electrically connected to upper interconnections 132 via the plurality of contacts CNT. Thereby, the voltage on the shield interconnections can be fixed more stably, and voltage transmission lines 120-122 can have higher noise resistances.

Shield interconnection 130 may be electrically connected via contacts to an interconnection at a lower layer fixed to a fixed potential.

In the arrangement of the interconnections shown in FIGS. 22 and 23, the shield interconnections may be made the same material as the gate interconnections (interconnections for forming gates of the MOS transistors) and may be located at the same layer as the gate interconnections. Thus, the shield interconnections may be formed in the same manufacturing steps as the gate interconnections. Also, the shield interconnections may be metal interconnections. Voltage transmission lines 120-122 or shield interconnection 130 shown in FIG. 23 may be gate interconnections.

In the structure shown in FIG. 22, voltage transmission lines 120-122 may be the gate interconnections, and a semiconductor substrate region may be utilized as the opposite shield line instead of lower shield interconnection 126. If the gate interconnections are used as voltage transmission lines 120-122, the MOS transistors receiving voltages V1-V3 on the gates are connected, and increase the interconnection capacitances so that such large interconnection capacitances can be utilized as stabilizer capacitances, and the noise resistances can be improved.

[Modification 3]

Figure 24:
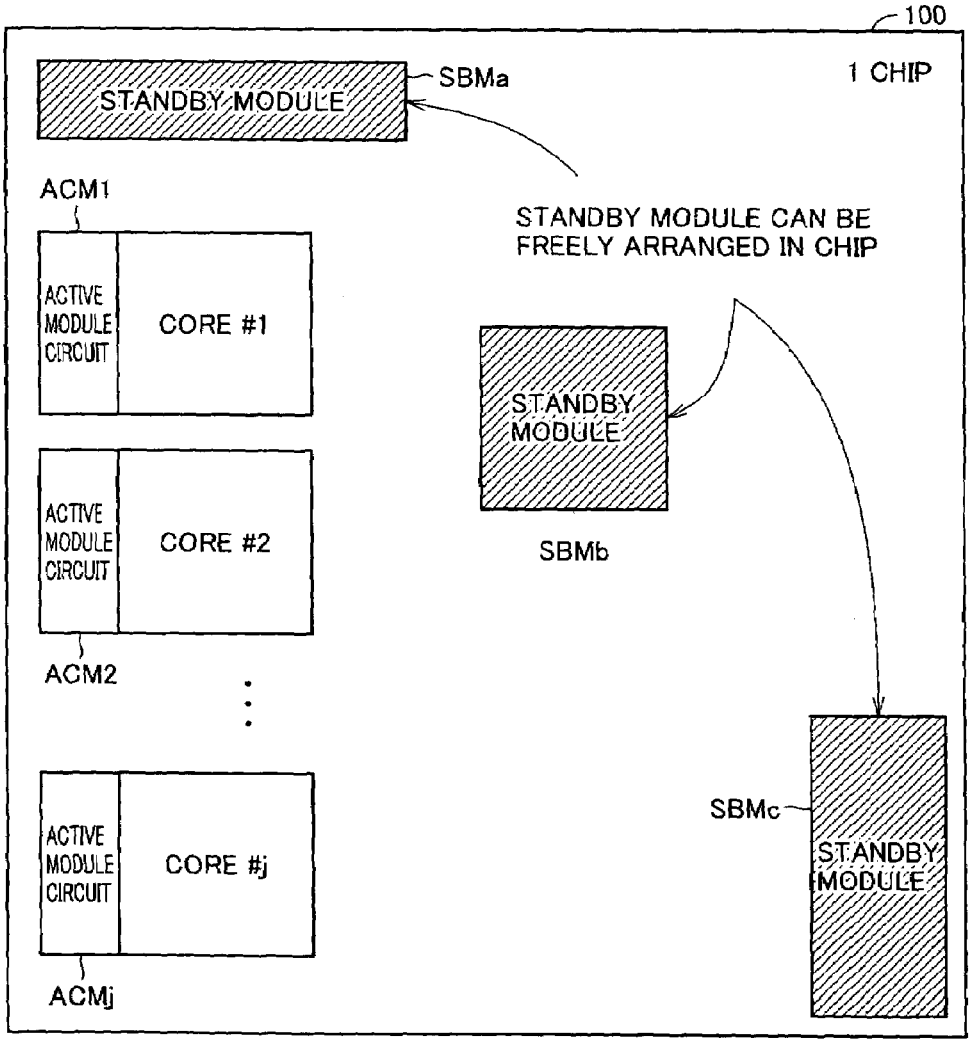
FIG. 24 schematically shows a chip layout of a semiconductor integrated circuit device of a modification of the sixth embodiment of the invention.

FIG. 24 schematically shows a chip layout of a semiconductor integrated circuit device according to a modification 3 of the sixth embodiment of the invention. In semiconductor integrated circuit device 100 shown in FIG. 24, standby modules SBMa-SBMc are arranged on a chip in a dispersed fashion. On the chip, active module circuits ACM1-ACMj are arranged corresponding to cores #1-#j, respectively. Cores #1-#j form function blocks (macros) together with corresponding active module circuits ACM1-ACMj, respectively, and the internal voltage is optimized for each of the function blocks (active module circuits).

In the structure shown in FIG. 24, standby modules SBMa-SBMc are isolated from core #1, and can be arranged as independent modules. This improves the flexibility in layout of cores #1-#j on the chip. In standby module SBM, the layout of arrangement of the internal voltage generating circuit is improved.

In the case where semiconductor integrated circuit device 100 forms a system LSI, and cores #1-#j include logics and mixed DRAMs, i.e., DRAMs arranged in a mixed fashion, the memory array unit in the mixed DRAM is configured for ensuring an intended breakdown voltage of memory cell transistors such that the design rule of the MOS transistor in the memory cell is larger (i.e., a gate insulating film is thicker) than those of MOS transistors in the logic circuit and a peripheral circuit. Therefore, the same design rules as those of the peripheral transistors of the mixed DRAM and the logic can be applied to standby modules SBMa-SBMc so that the layout area of the standby module can be reduced.

These standby modules SBMa-SBMc may-be configured to generate voltages independently of each other or to generate the same voltage. According to the reference voltage produced by one of the standby modules, the other standby modules may produce internal voltages at the predetermined voltage level.

According to the sixth embodiment of the invention, as described above, the standby module transmitting the voltage commonly used by the respective core circuits is arranged for sharing by the core circuits so that the chip footprint can be reduced, and the current consumption during standby can be reduced.

Seventh Embodiment

Figure 25:
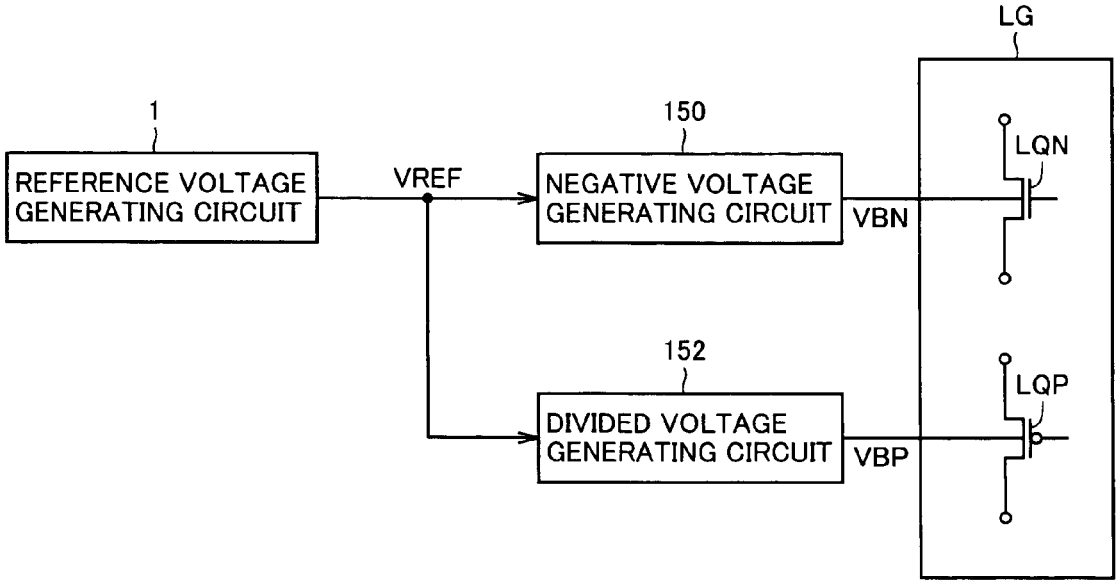
FIG. 25 schematically shows a structure of a power supply module of a semiconductor integrated circuit device according to a seventh embodiment of the invention.

FIG. 25 schematically shows a structure of a power supply module according to a seventh embodiment of the invention. FIG. 25 shows a structure of a power supply module for a logic LG such as a processor executing predetermined processing. In FIG. 25, the power supply module includes a negative voltage generating circuit 150, which produces a negative voltage VBN according to reference voltage VREF provided from reference voltage generating circuit 1, and a divided voltage generating circuit 152, which performs a voltage dividing operation to produce a divided voltage VBP according to reference voltage VREF.

Logic LG includes an N-channel logic transistor LQN receiving negative voltage VBN provided from negative voltage generating circuit 150 on its back gate, and a P-channel logic transistor LQP receiving output voltage VBP of divided voltage generating circuit 152 on its back gate. Logic transistors LQN and LQP may be transistors performing logical processing in logic LG, or may be components of a differential amplifier such as a sense amplifier.

In the case where logic transistors LQN and LQP perform the logical processing (i.e., logic transistors LQN and LQP are utilized as pass transistors or components of logic gates), output voltage VBN of negative voltage generating circuit 150 is set to the voltage level lower than the ground voltage, and output voltage VBP of divided voltage generating circuit 152 is set to the voltage level higher than logic power supply voltage (VDDL). However, it is assumed that drive signals of these transistors vary between the logic power supply voltage and the ground voltage. Thereby, even if logic transistors LQN and LQP have thin gate insulating films, and thus have low threshold voltages, the substrate effect can increase the absolute values of the threshold voltages, and off-leak currents can be reduced so that the low power supply voltage and fast operation can be achieved.

If logic transistors LQN and LQP are used, e.g., in a differential amplifier, and therefore must have high sensitivity, it is necessary to lower the threshold voltages. In this case, negative voltage VBN is set to a voltage level close to the ground voltage level, and divided voltage VBP is set to a voltage level close to the logic power supply voltage. In this case, such setting may be alternatively employed that voltage VBN is positive, and voltage VBP is at a voltage level lower than the logic power supply voltage. Thus, the back gate bias may be set positive. In this case, a low voltage generating circuit shown in FIG. 16 is used instead of negative voltage generating circuit 150, and produces a substrate bias voltage VBN for logic transistor LQN. Therefore, negative voltage generating circuit 150 and divided voltage generating circuit 152 may employ the structures shown in FIGS. 4 and 17, and may utilize, if necessary, the low voltage generating circuit shown in FIG. 16 so that the power supply module, which operates fast with a low power supply voltage, can be achieved for the logic.

In the structure having the logic and the memory in the mixed fashion, reference voltage generating circuit 1 may be used as the standby module, and circuits producing actual bias voltages VBN and VPP may be arranged such that these circuits for the logic core circuit are independent of those for the memory core circuit (i.e., a dispersed arrangement of the standby modules is employed). Thereby, the substrate bias voltages at different voltage levels can be easily produced for the memory core circuit and the logic core circuit, respectively.

According to the seventh embodiment of the invention, as described above, the back gate bias voltage of the logic transistor is produced based on the reference voltage, of which temperature characteristic can be easily adjusted even with a low power supply voltage, and the voltage at a desired voltage level can be stably produced for the logic circuit, which operates fast with a low power supply voltage. Thereby, the power supply modules of the common structure can be applied to both the logic and the memory even in the system LSI, respectively, and thereby can produce the required internal voltages. This improves the design efficiency.

In general, the invention can be applied to the semiconductor device using the voltage at the level different from the power supply voltage level. In particular, the invention may be utilized in the power supply module of the system-on-chip or system LSI, in which the low power supply voltage and the low power consumption are required, so that the internal voltage having the desired temperature characteristic can be stably produced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An internal voltage generating circuit comprising:

a first reference voltage generating circuit generating a first reference voltage;

a voltage dividing circuit producing a second reference voltage by dividing said first reference voltage, wherein said voltage dividing circuit includes a voltage-follower-connected differential amplifier receiving said first reference voltage, and a divided voltage output circuit dividing an output voltage of said differential amplifier to produce and output said second reference voltage; and a divided voltage producing circuit dividing said second reference voltage to produce a divided voltage, wherein said divided voltage producing circuit includes:

a resistance division circuit effecting resistance division on said second reference voltage, a first level shifter effecting level shift on an output voltage of said resistance division circuit, a second level shifter effecting level shift on said divided voltage, and a drive circuit making a comparison between an output voltage of said second level shifter and an output voltage of said first level shifter to produce said divided voltage according to a result of said comparison.

2. The internal voltage generating circuit according to claim 1, wherein said first and second level shifters include insulated gate field-effect transistors having thick gate insulating films and operating in a source follower mode.

3. The internal voltage generating circuit according to claim 1, wherein said drive circuit includes:

a comparing circuit having a differential stage receiving the output voltages of said first and second level shifters and allowing adjustment of a ratio, a current supply coupled to said differential stage and determining a drive current of said differential stage, and a drive element producing said divided voltage according to an output signal of said comparing circuit.

* * * * *